US007399009B2

(12) United States Patent
Hall et al.

(10) Patent No.: US 7,399,009 B2
(45) Date of Patent: Jul. 15, 2008

(54) LOAD FLOOR LATCH

(75) Inventors: Matthew Hall, Worcester (GB); Gert Berg, Worcester (GB); Richard Horton, Stourbridge (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 10/920,767

(22) Filed: Aug. 18, 2004

(65) Prior Publication Data

US 2005/0140150 A1 Jun. 30, 2005

Related U.S. Application Data

(60) Provisional application No. 60/533,426, filed on Dec. 30, 2003, provisional application No. 60/496,100, filed on Aug. 18, 2003.

(51) Int. Cl.
*E05C 19/10* (2006.01)
*E05C 1/08* (2006.01)

(52) U.S. Cl. ..... 292/100; 292/32; 292/140; 292/163; 292/333; 292/336.3; 292/DIG. 31

(58) Field of Classification Search ..... 292/100, 292/32, 40, 126, 163, 332, 333, DIG. 31, 292/DIG. 69, 137, 336.3; 70/204
See application file for complete search history.

(56) References Cited

U.S. PATENT DOCUMENTS

| | | | | | |
|---|---|---|---|---|---|
| 10,460 | A | * | 1/1854 | Mix | 72/88 |
| 897,924 | A | * | 9/1908 | Prouty | 70/100 |
| 966,208 | A | * | 8/1910 | Hoes | 70/108 |
| 1,073,057 | A | | 9/1913 | Schmid | 292/99 |
| 1,075,914 | A | * | 10/1913 | Hoes | 70/108 |
| 1,090,305 | A | * | 3/1914 | Hoffman | 70/100 |
| 1,133,962 | A | * | 3/1915 | Höglund | 292/164 |
| 1,299,195 | A | * | 4/1919 | Kohn | 70/157 |
| 1,850,222 | A | * | 3/1932 | Carlson | 292/33 |
| 2,186,903 | A | | 1/1940 | Gleason | 292/254 |
| 2,600,485 | A | | 6/1952 | Colonna | 292/173 |
| 2,649,322 | A | | 8/1953 | Mack | 292/173 |

(Continued)

FOREIGN PATENT DOCUMENTS

| | | |
|---|---|---|
| DE | 20316663 | 6/2004 |

(Continued)

*Primary Examiner*—Carlos Lugo
(74) *Attorney, Agent, or Firm*—Paul & Paul

(57) ABSTRACT

A load floor latch for securing a first closure member to a second closure member panel such that when the first and second closure members are fastened, the latch is opened by actuating the handle and the pawl is retracted into the latch. A biasing device such as a torsion spring acts on a locking arm so as to pivot the locking arm such that it engages a slot on the pawl. This maintains the pawl in the retracted position. When the first closure member to which the latch is attached is closed so as to bring the first closure member into a closed position with respect to the second closure member, a projection on the locking arm contacts a contact member such that the locking arm is pivoted and the locking arm no longer remains in the slot in the pawl. The pawl is then free to extend out of the latch to a latched position by the action of a compression spring and engage a keeper on the second closure member to thus fasten the first and second closure members.

19 Claims, 31 Drawing Sheets

U.S. PATENT DOCUMENTS

| | | | | | |
|---|---|---|---|---|---|
| 2,763,503 | A | | 9/1956 | Tasch et al. | 292/273 |
| 2,987,908 | A | | 6/1961 | Pelcin | 70/483 |
| 3,494,650 | A | | 2/1970 | Slopa | 292/92 |
| 3,495,862 | A | | 2/1970 | McClintock | 292/173 |
| 3,621,686 | A | * | 11/1971 | Klein | 70/157 |
| 3,743,336 | A | | 7/1973 | Andrews | 292/173 |
| 3,758,140 | A | | 9/1973 | Prete, Jr. | 292/223 |
| 3,782,141 | A | | 1/1974 | Doerrfeld | 70/487 |
| 4,000,539 | A | * | 1/1977 | Neyer | 16/441 |
| 4,138,869 | A | | 2/1979 | Pelcin | 70/151 |
| 4,179,771 | A | * | 12/1979 | Rankins et al. | 16/441 |
| 4,186,952 | A | | 2/1980 | Glass | 292/202 |
| 4,321,812 | A | | 3/1982 | Pelcin | 70/472 |
| 4,322,958 | A | | 4/1982 | Eigmemeier | 70/107 |
| 4,335,595 | A | | 6/1982 | Swan | 70/149 |
| 4,438,964 | A | | 3/1984 | Peters | 292/126 |
| 4,492,396 | A | | 1/1985 | Luke et al. | 292/228 |
| 4,542,924 | A | | 9/1985 | Brown et al. | 292/87 |
| 4,552,001 | A | | 11/1985 | Roop | 70/208 |
| 4,638,649 | A | | 1/1987 | Chao | 70/71 |
| 4,650,230 | A | | 3/1987 | Takasaki | 292/173 |
| 4,683,736 | A | | 8/1987 | Weinerman et al. | 70/208 |
| 4,704,882 | A | | 11/1987 | Takasaki | 70/215 |
| 4,762,346 | A | | 8/1988 | King | 292/38 |
| 4,854,619 | A | * | 8/1989 | Nakauchi | 292/335 |
| 4,969,916 | A | | 11/1990 | Weinerman et al. | 70/208 |
| 5,076,620 | A | * | 12/1991 | Campbell et al. | 292/138 |
| 5,292,159 | A | | 3/1994 | Sandhu et al. | 292/173 |
| 5,297,400 | A | | 3/1994 | Benton et al. | 70/1.5 |
| 5,297,404 | A | | 3/1994 | Embry | 70/1.5 |
| 5,301,989 | A | | 4/1994 | Dallmann et al. | 292/142 |
| 5,321,962 | A | | 6/1994 | Ferchau et al. | 70/208 |
| 5,326,141 | A | | 7/1994 | Gorman | 292/66 |
| 5,340,174 | A | | 8/1994 | Bender et al. | 292/336.3 |
| 5,413,391 | A | | 5/1995 | Clavin et al. | 292/170 |
| 5,498,038 | A | | 3/1996 | Simon et al. | 292/36 |
| 5,689,980 | A | | 11/1997 | Weinerman et al. | 70/208 |
| 5,820,175 | A | | 10/1998 | Clavin | 292/165 |
| 5,878,608 | A | | 3/1999 | Alyanakian | 70/208 |
| 5,927,773 | A | | 7/1999 | Larsen et al. | 292/337 |
| 6,023,953 | A | | 2/2000 | Vickers | 70/208 |
| 6,045,169 | A | * | 4/2000 | Frolov | 292/332 |
| 6,079,756 | A | | 6/2000 | Phillips | 292/198 |
| 6,109,669 | A | | 8/2000 | Pinkow | 292/175 |
| 6,120,071 | A | * | 9/2000 | Picard et al. | 292/165 |
| 6,152,501 | A | | 11/2000 | Magi et al. | 292/336.3 |
| 6,409,234 | B1 | | 6/2002 | Larsen | 292/173 |
| 6,460,902 | B1 | | 10/2002 | Kyle | 292/165 |
| 6,626,472 | B1 | | 9/2003 | Berg | 292/336.3 |

FOREIGN PATENT DOCUMENTS

| | | |
|---|---|---|
| GB | 471012 | 8/1937 |
| GB | 573165 | 11/1945 |
| GB | 1 423 258 | 2/1976 |
| WO | WO 00448870 A | 8/2000 |

* cited by examiner

LOAD FLOOR LATCH

This application claims the benefit of U.S. Provisional Application No. 60/533,426 filed Dec. 30, 2003 and U.S. Provisional Application No. 60/496,100 filed Aug. 18, 2003.

BACKGROUND OF THE INVENTION

The present invention relates to the field of latches and more particularly to load floor latches in which a handle is lifted to release the latch from engagement with a keeper.

Load floor latches are known in the art and are employed in a number of applications. Generally, latches in this category operate by forcing a pawl into engagement with a keeper. For example, where a first closure member has a pawl and a second closure member has a keeper thereon closing first closure member against the second closure member secures the closure members. The latch can be repeatedly latched and unlatched by a user who desires to fasten and unfasten the first closure member to the second closure member.

One drawback with the previous load floor latches was that the pawl of the latch needed to slide into position and engage a keeper. Sliding type pawls in load floor latches did not positively engage keepers on the vehicles to the degree desired by a user.

A need exists for a latch which positively engages a keeper by the rotation of a pawl towards the keeper.

In addition, load floor latches, which is one application for the latches of the present invention, are commonly used in the automotive industry. Often, these latches are employed to secure the contents of a compartment in a cargo area. The latch of the present invention can be used in compartments and bins in various locations such as glove compartments and storage areas in vehicles. For example, load floor latches find use for securing a floor panel, such as the panel which regulates access to vehicle items, such as spare tires, tools, jacks, batteries, and the like. In many cases, the floor panel is provided on the floor of a passenger vehicle or cargo compartment. The latch therefore must be durable, and it is desirable that the latch be able to withstand substantial force loads, such as those of the type generally encountered by bumps, rough terrain, and especially vehicular accidents, such as crashes, or rollover situations. It is important that compartment contents remain secured in the event of a vehicle crash or rollover. This is especially more important where the cargo compartment is located in the same general area as the vehicle operator, or other passengers. For example, in station wagon type vehicles, the cargo space for passengers and items of cargo is the same. Thus, in this type of vehicle, there is great danger to be encountered should a rollover of the vehicle occur and the latch becomes unsecured. If this were to happen, the compartment contents would spill out into the passenger compartment, thereby placing the vehicle operator in danger. A need exists for a load floor latch which has improved abilities to withstand a rollover, and facilitate latching of a panel, even under high stress conditions. It is also important that the latch, in addition to being durable, be easy to construct and install.

SUMMARY OF THE INVENTION

The present invention is directed to a latch having a housing which holds a handle, a pawl member and a spring which biases a pawl into engagement with a keeper member. The latch handle retracts the pawl from engagement with a keeper member by engaging the pawl. As the handle is lifted it pivots relative to the housing to engage the pawl and draw the pawl away from the keeper member. The pawl is retracted against the bias of the spring member. When the handle is lifted and the pawl retracts a predetermined amount, a locking arm pivots due to forces acting on the locking arm by a biasing device such as a torsion spring to engage a slot in the pawl and prevents further retracting movement of the pawl. As the locking arm pivots and is engaged in the slot, a projection on the locking arm pivots such that the locking arm projection projects out of the housing of the latch.

When the projection on the locking arm is engaged in the slot on the pawl, the pawl cannot further retract or extend but is fixed in a retracted position until the latch is once again moved to a closed position. When a user moves the first closure member into a closed position with the second closure member such that the locking arm projection contacts the second closure member and allows the locking arm to pivot, the pivoting movement permits the locking arm to disengage the slot on the pawl. The pawl is now free to move to a fully extended and latched position by the biasing forces acting on the pawl in a linear direction away from the housing of the latch by a biasing device such as a compression spring. The latch and first and second closure members are now in a closed and fastened position.

Yet another object of the present invention is to provide a latch which has a detent which is a linear actuator and maintains the pawl in a retracted position when the latch is unlatched such that the detent upon contact with the second closure member disengages from the pawl and permits extension of the pawl to a latched and extended position from a retracted unlatched position.

The housing preferably provides a gripping area or recess for facilitating grasping of the handle by a user. The housing can further provide a barrier to the compartment covered by the floor panel so that no objects inadvertently fall into the compartment through the latch.

Another object of the invention is to provide a spring biased latch which allows a first panel to be fastened by forces acting on a pawl of the latch by a second panel. This is accomplished by the shape of the pawl which interacts with a keeper on the second panel.

Another object of the present invention is to provide a latch which can be used in connection with panels of vehicles to regulate access to and from an area or compartment, such as, for example, a floor panel and a floor storage compartment.

It is another object of the present invention to provide a latch which can be used in an installation where the latch is mounted on a closure panel to regulate entry into an enclosure covered by the closure panel and provide a barrier to prevent a user's hand or fingers, or objects, from inadvertently entering the compartment.

Another object of the present invention is to provide a novel latch which can secure one or more panels or members together, for release upon actuating a handle of the latch.

These and other objects of the present invention will be more readily apparent when taken into consideration with the following description and the attached drawings.

DETAILED DESCRIPTION OF THE INVENTION

Figure 1:
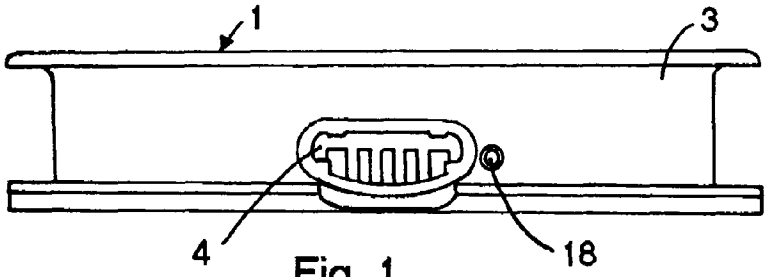
FIG. 1 is a front lavational view of an embodiment of a latch in accordance with the present invention showing the main pawl and housing.
Figure 3:
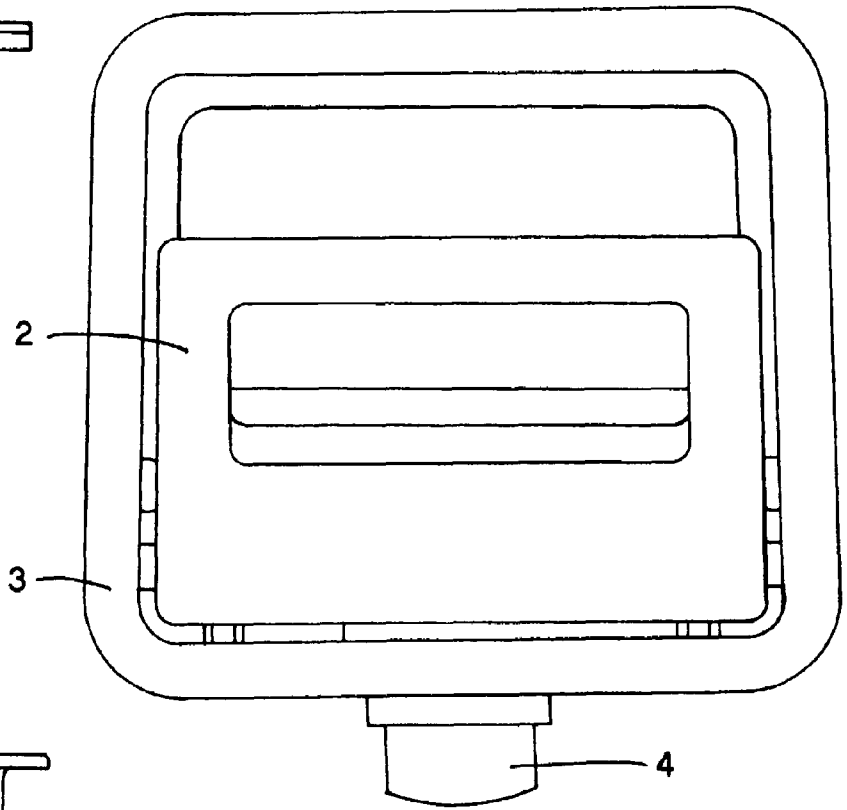
FIG. 3 is a top plan view of the latch of FIG. 1 showing the pawl in the extended position.
Figure 2:
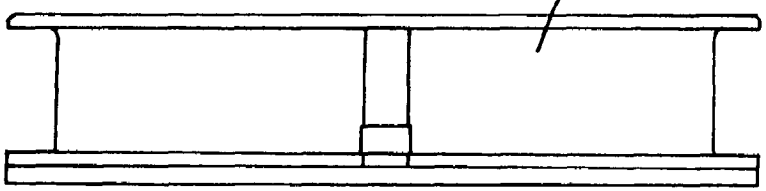
FIG. 2 is a rear lavational view of the latch of FIG. 1.
Figure 5:
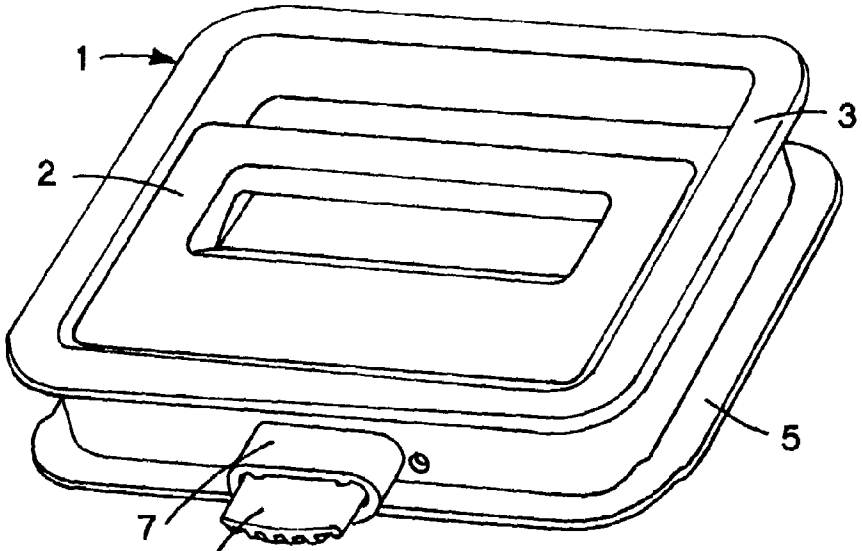
FIG. 5 is a perspective view of the latch of FIG. 1 showing the pawl in the extended position.
Figure 6:
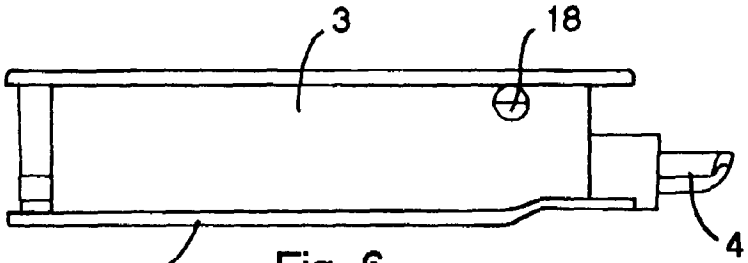
FIG. 6 is a side lavational view of the latch of FIG. 1 showing the pawl in the extended position.
Figure 4:
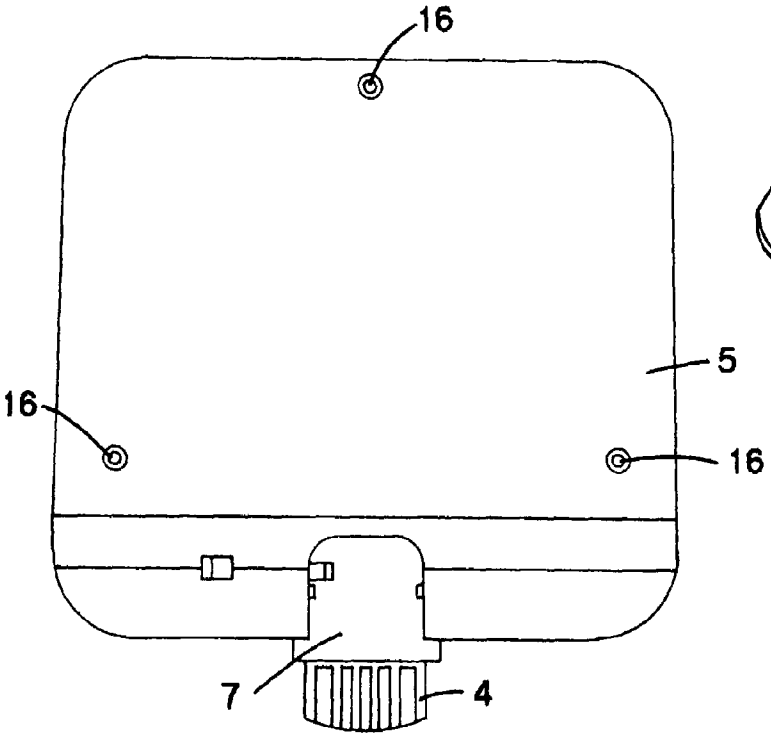
FIG. 4 is a bottom plan view of the latch of FIG. 1 showing the pawl in the extended position.
Figure 7:
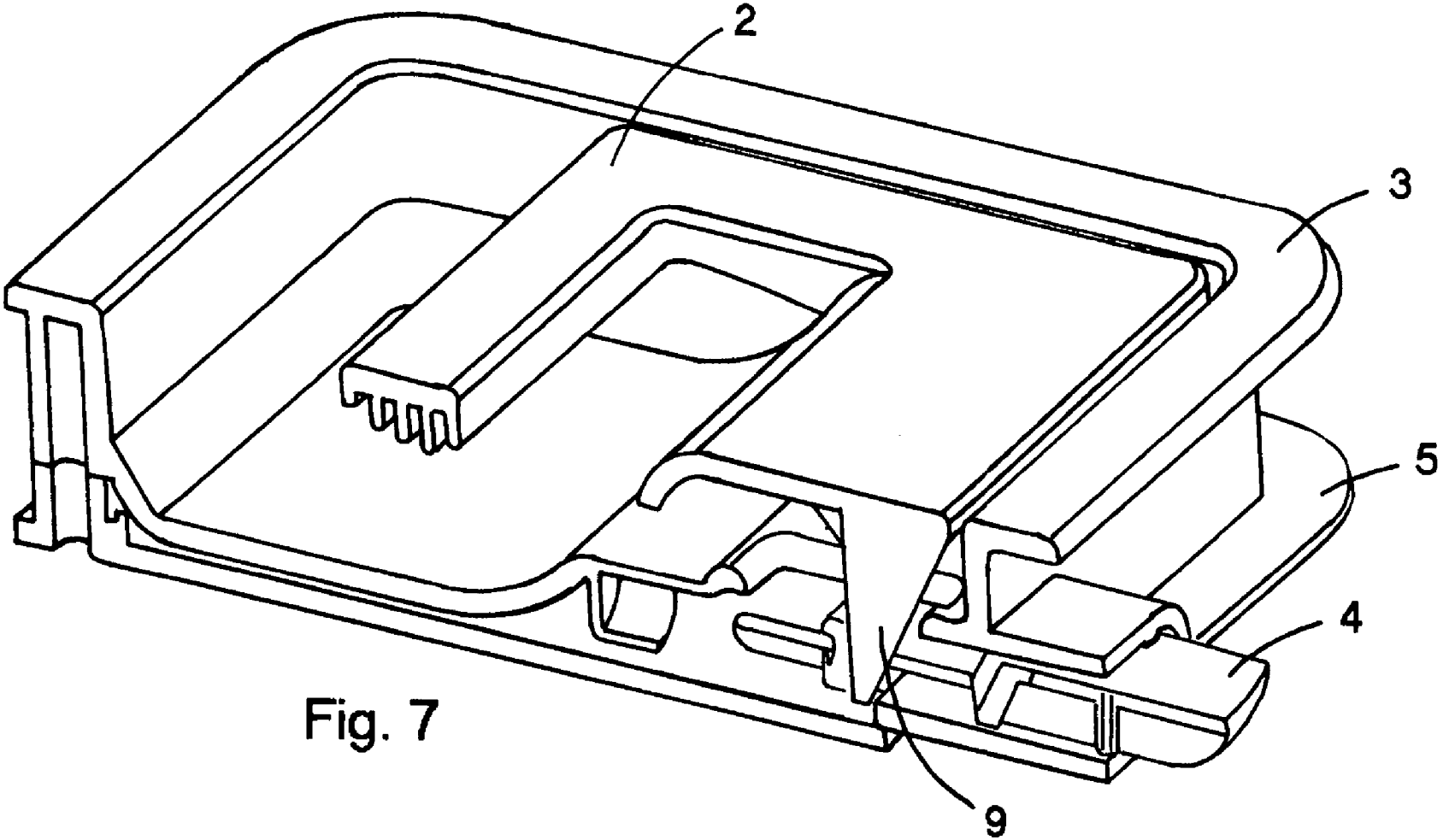
FIG. 7 is a sectional view of the latch of FIG. 1.
Figure 8:
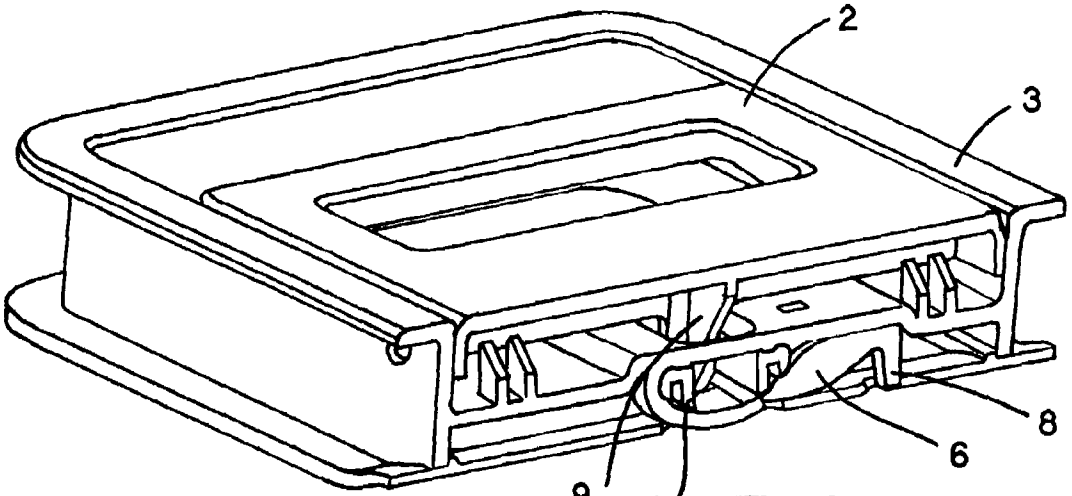
FIG. 8 is a cross sectional side view of the latch of FIG. 1.
Figure 9:
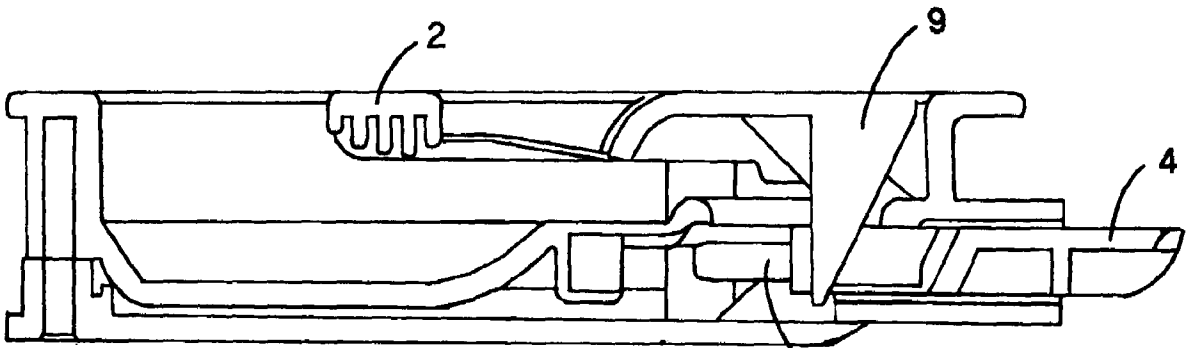
FIG. 9 is a cross sectional side view of the latch of FIG. 1.

Referring now to the drawings in detail, wherein like reference numerals indicate like elements through the several views, there is shown in FIG. 1-9, views of an embodiment of a latch 1 in accordance with the present invention with a lower housing piece 3, upper housing piece 5 and handle 2. The lower housing piece 3 can be connected to the upper housing piece 5 by means of screws in screw holes 16 in the upper and lower housing pieces, 33 and 35 respectively.

Figure 10:
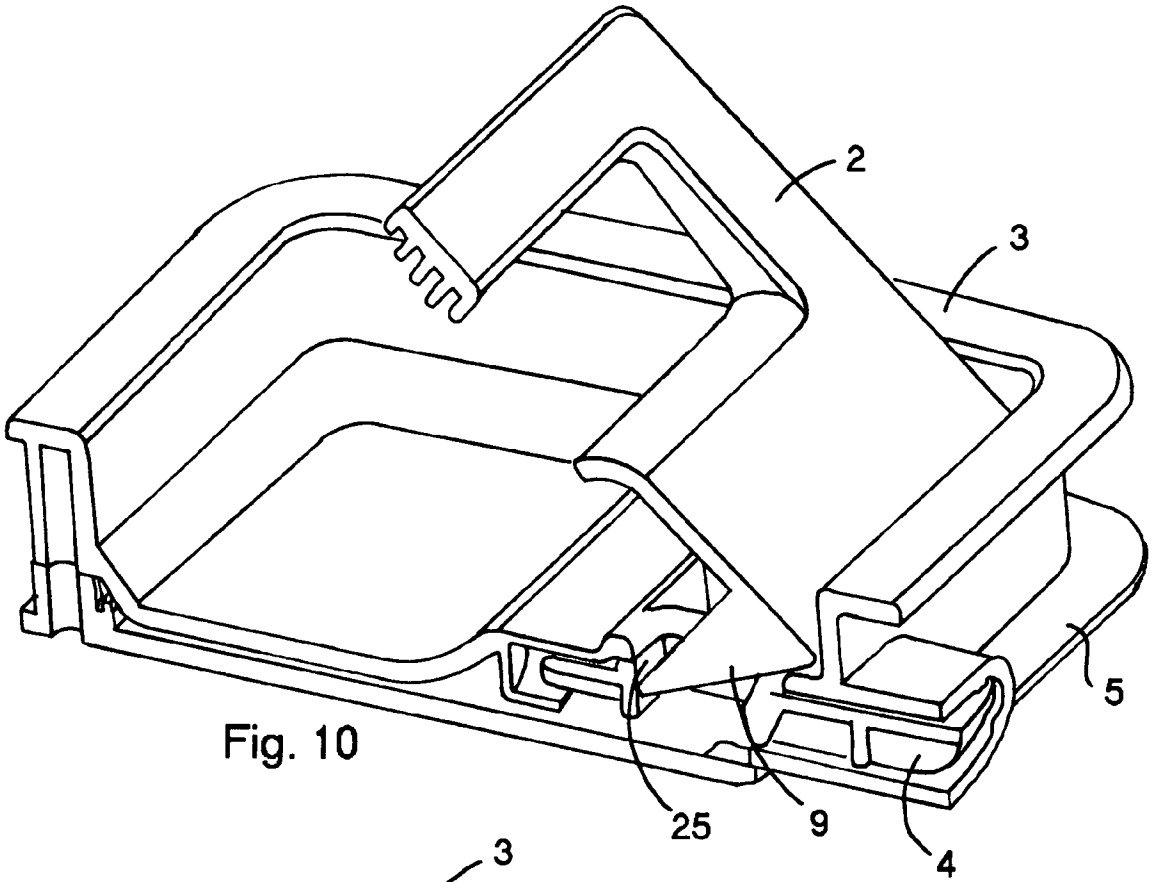
FIG. 10 is a sectional view of the latch of FIG. 1 with the handle actuated and the pawl retracted.

FIGS. 10 and 12-14 show the actuation of the main pawl 4 during rotation of handle 3. As the handle 2 is rotated from the rest position shown in FIGS. 1, 4-7 and 9 the pawl 4 moves toward the rear of the housing 3 thereby placing the pawl 4 in the open or retracted position so that the pawl 4 no longer protrudes in a fully extended position from the housing 3 as shown in FIG. 10 due to the action of the handle actuator 9 on the pawl. A pawl guide 7 acts as a guide for the retracting and extending movement of the pawl 4.

Figure 35:
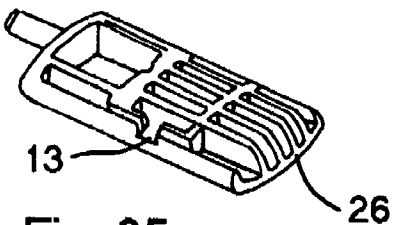
FIG. 35 is a perspective view of the bottom of the pawl of the latch of FIG. 1.
Figure 34:
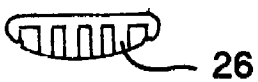
FIG. 34 is a front view of the pawl of the latch of FIG. 1.
Figure 33:
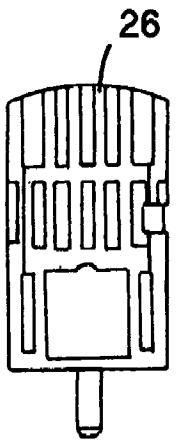
FIG. 33 is a bottom view of the pawl of the latch of FIG. 1.
Figure 50:
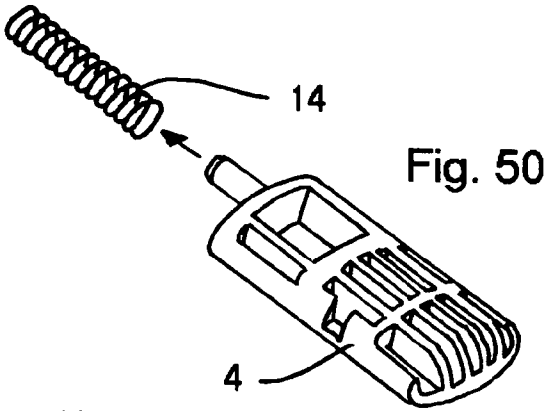
FIG. 50 is a perspective view of the compression spring being fitted to the pawl.
Figure 49:
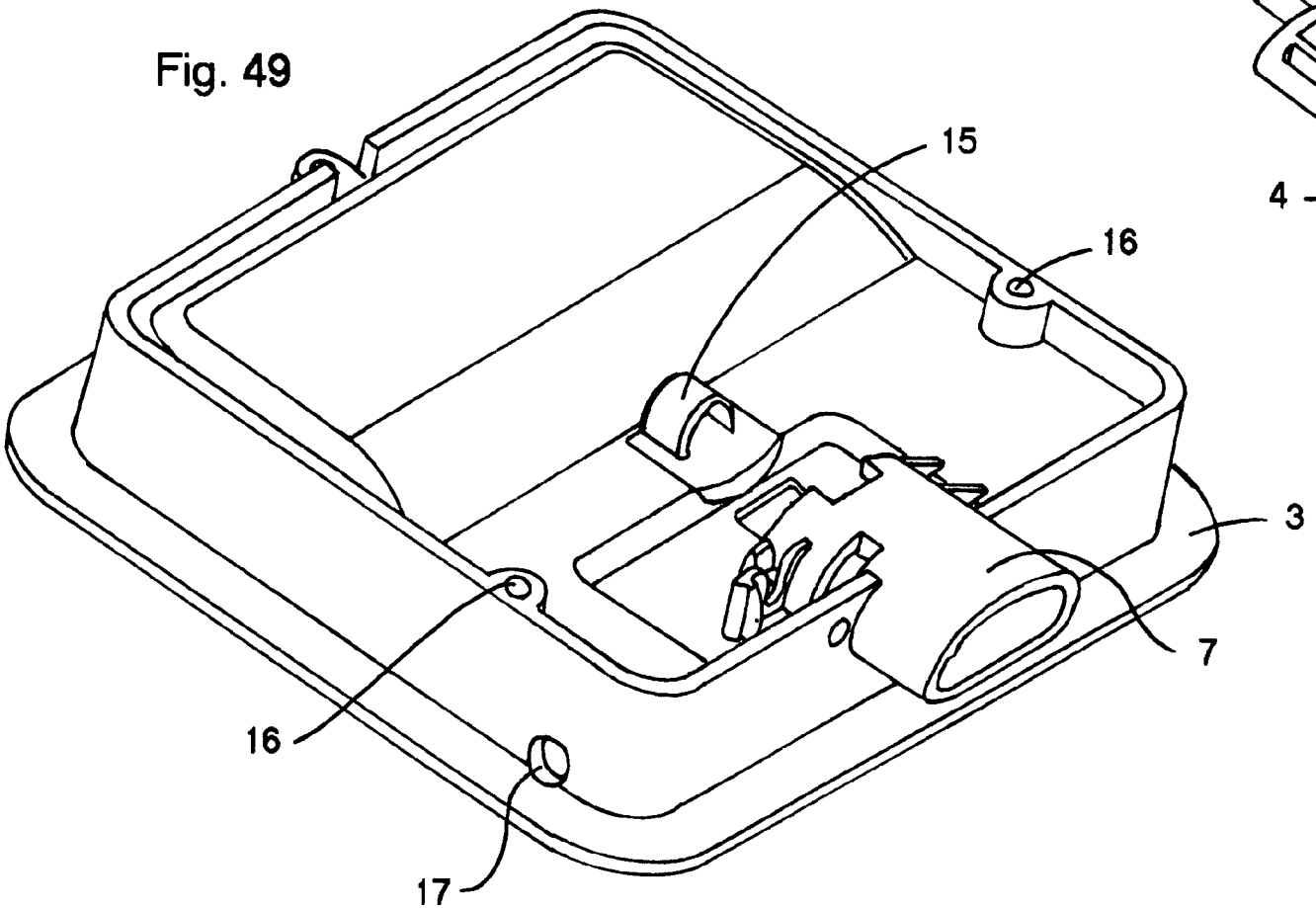
FIG. 49 is a perspective view of the latch of FIG. 1 showing a compression spring being inserted into the compression spring holder.
Figure 51:
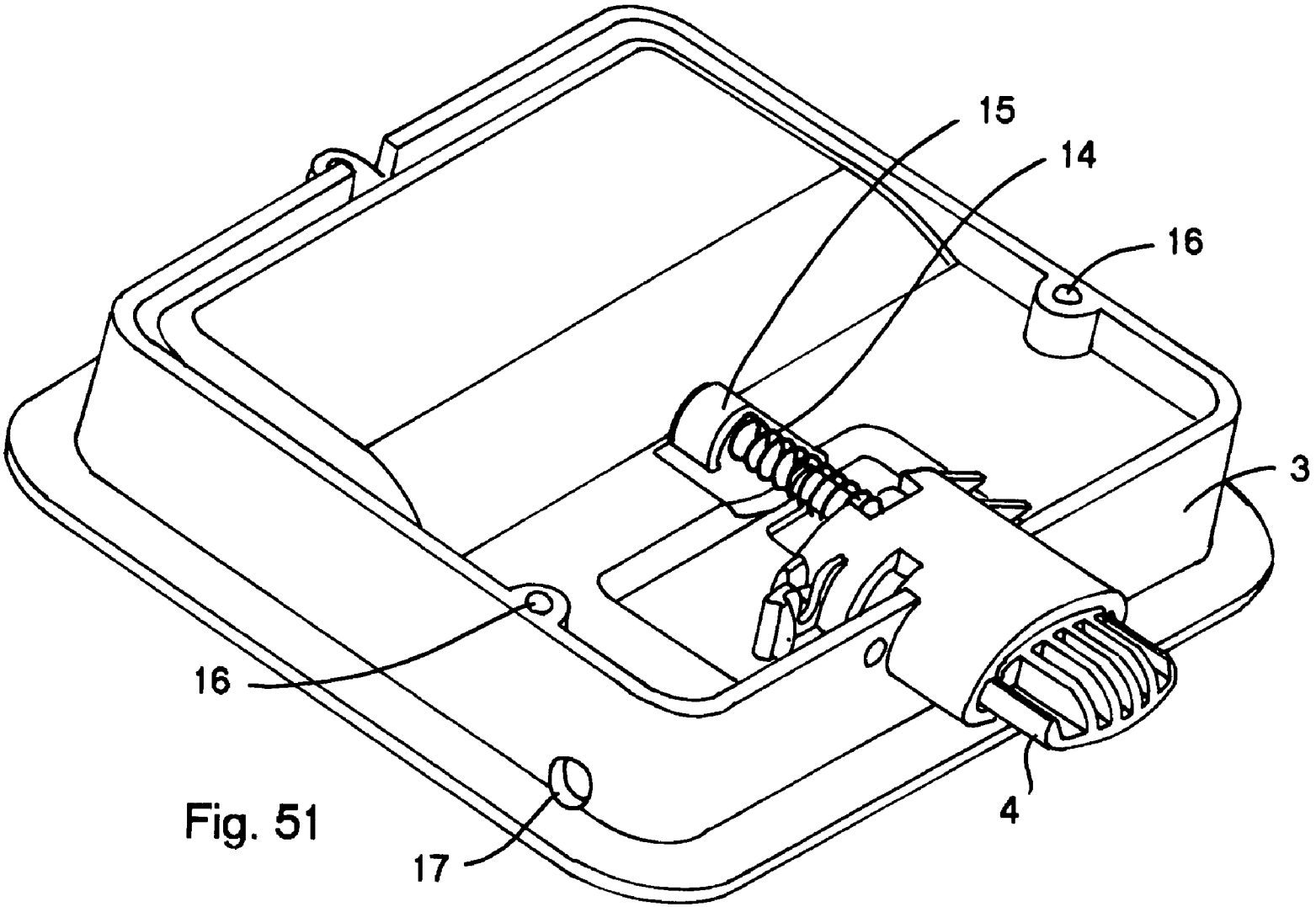
FIG. 51 is a perspective view of the bottom of the upper housing piece of the latch of FIG. 1 with the compression spring fitted to the pawl.

Compression spring 14 which is shown in FIGS. 49-51 is configured to be connected to the pawl 4. The pawl as shown in FIGS. 30-35 has an exterior face 26 which acts upon the keeper (not shown) and an interior face 25 which is acted upon by the handle actuator 9. The pawl has a slot 13 for engagement with the locking arm as shown in FIG. 35.

Figures 12, 13:
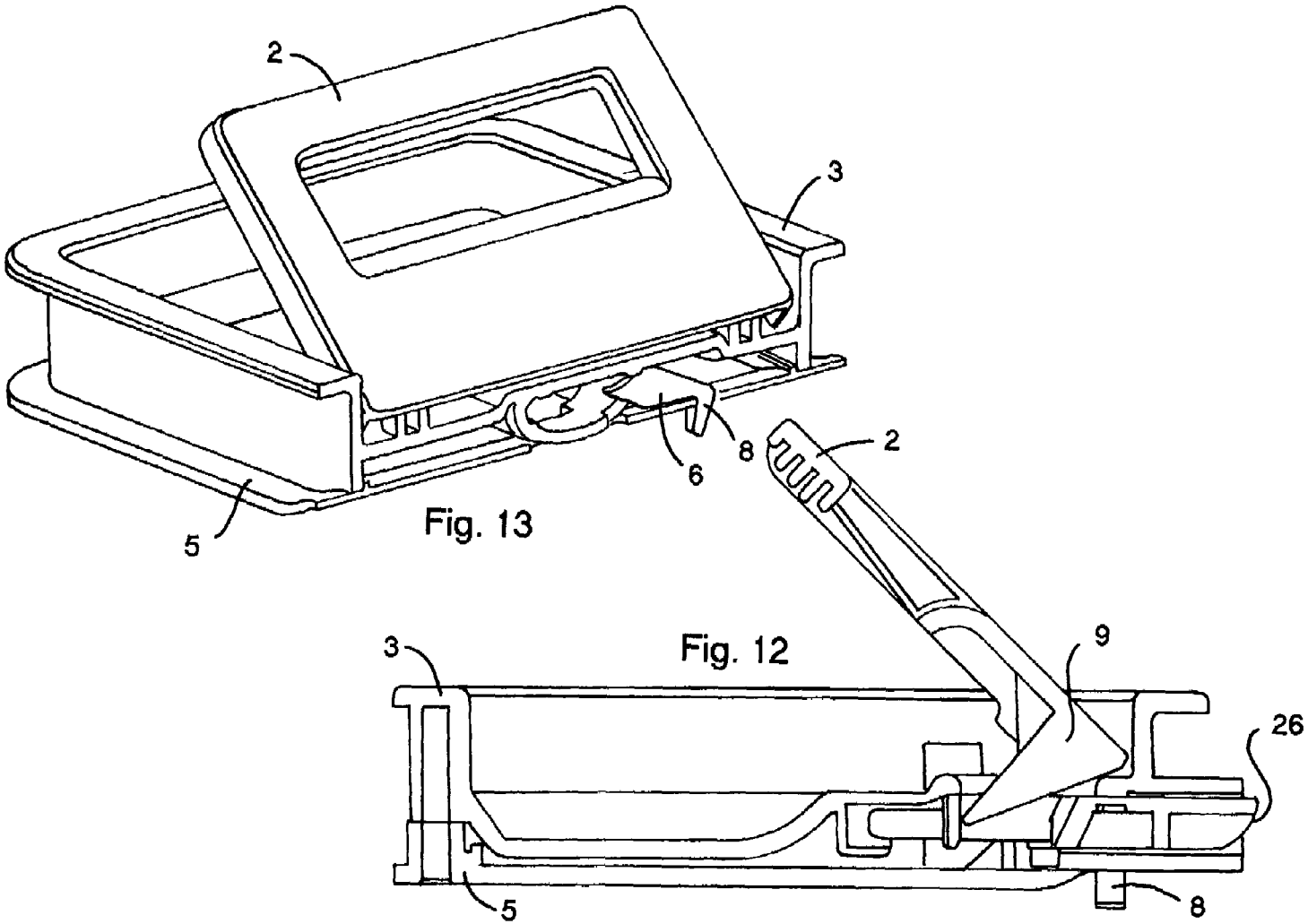
FIG. 12 is a cross sectional side view of the latch of FIG. 1 with the handle actuated and the pawl retracted.
FIG. 13 is a perspective view of the latch of FIG. 1 shown in cross section with the handle actuated and the pawl removed and the locking arm in an engaged position.
Figure 14:
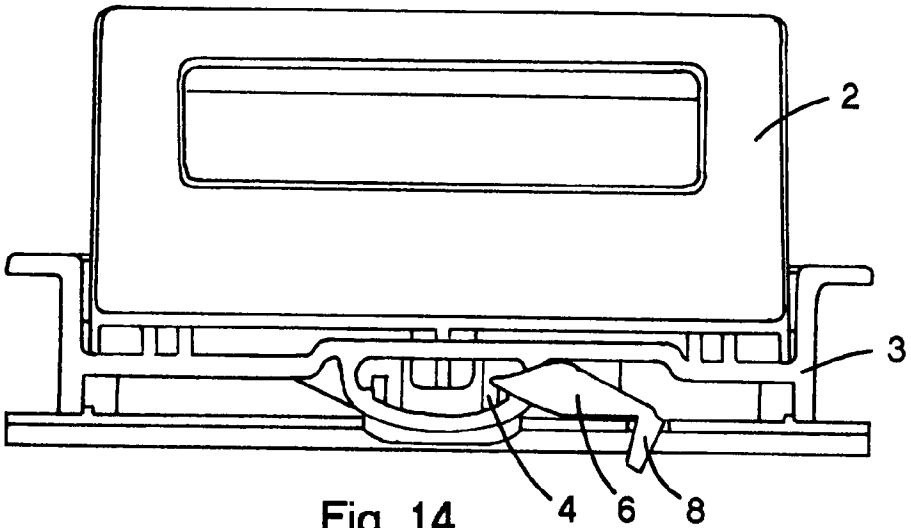
FIG. 14 is a front view of the latch of FIG. 1 shown in cross section with the pawl removed and the locking arm in an engaged position.
Figure 24:
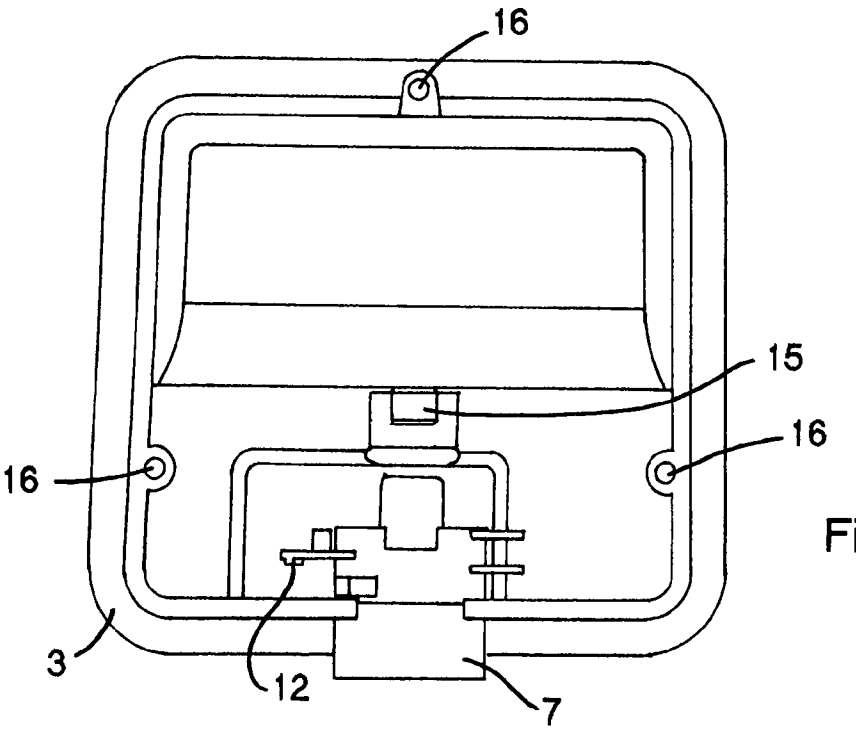
FIG. 24 is a top plan view of the upper housing piece for the latch of FIG. 1.
Figure 25:
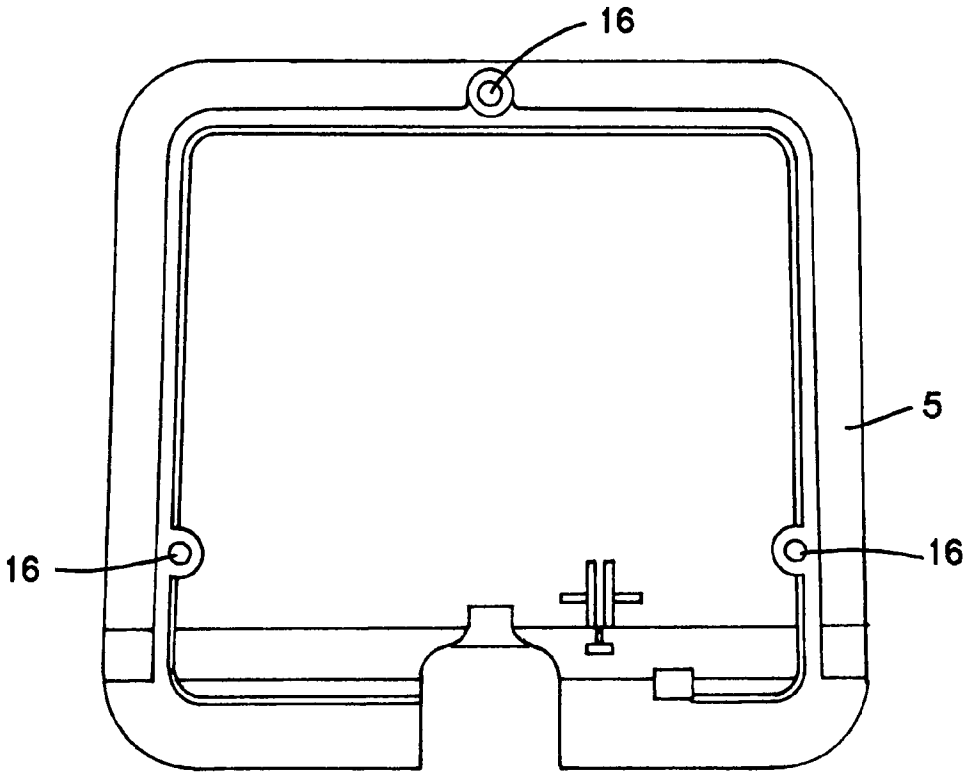
FIG. 25 is a top plan view of the lower housing piece for the latch of FIG. 1.
Figure 27:
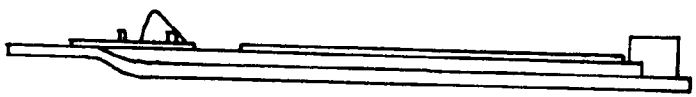
FIG. 27 is a side view of the lower housing piece for the latch of FIG. 1.
Figure 26:
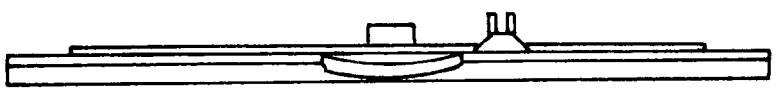
FIG. 26 is a front view of the lower housing piece for the latch of FIG. 1.
Figure 28:
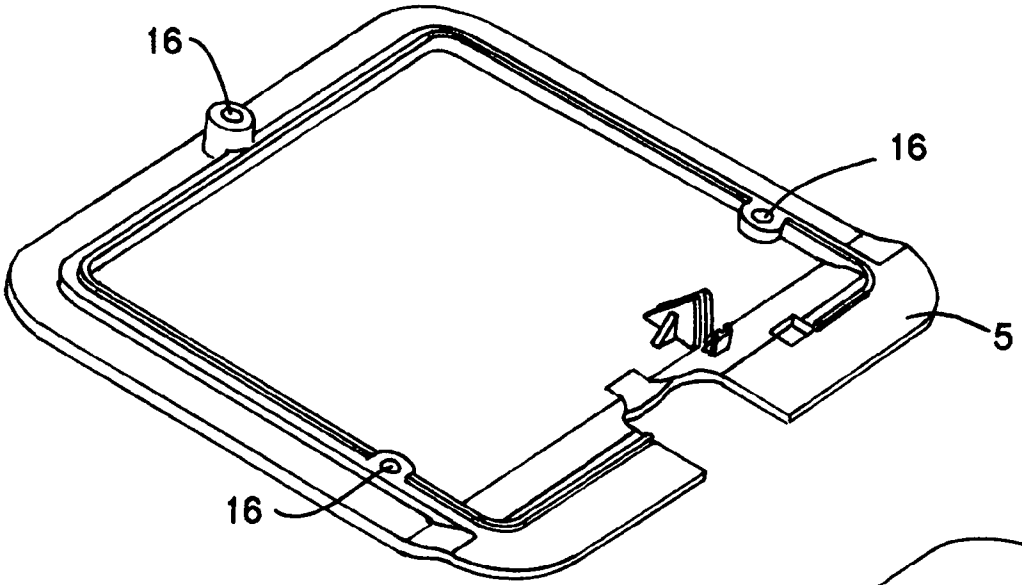
FIG. 28 is a perspective view of the top of the upper housing piece for the latch of FIG. 1.
Figure 29:
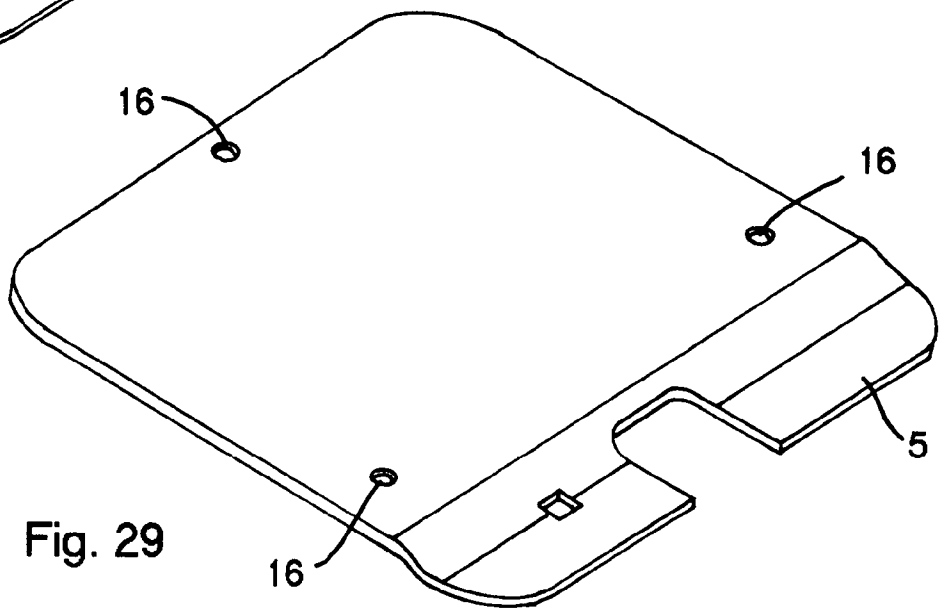
FIG. 29 is a perspective view of the bottom of the upper housing piece for the latch of FIG. 1.
Figure 32:
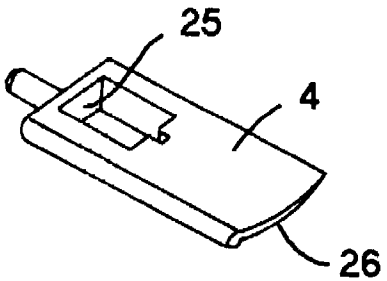
FIG. 32 is a perspective view of the pawl of the latch of FIG. 1.
Figure 31:
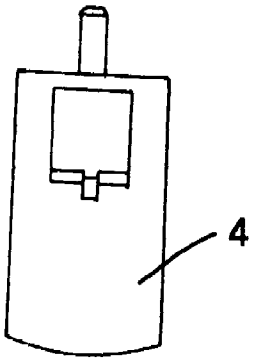
FIG. 31 is a top plan view of the pawl of the latch of FIG. 1.
Figure 30:
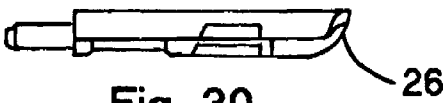
FIG. 30 is a side view of the pawl of the latch of FIG. 1.

In FIG. 12, the latch is shown being actuated by the application of force by a user on the handle with the compression spring removed. As shown in FIGS. 24 and 25, the compression spring 14 can be inserted into a compression spring holder 15.

Figure 36:
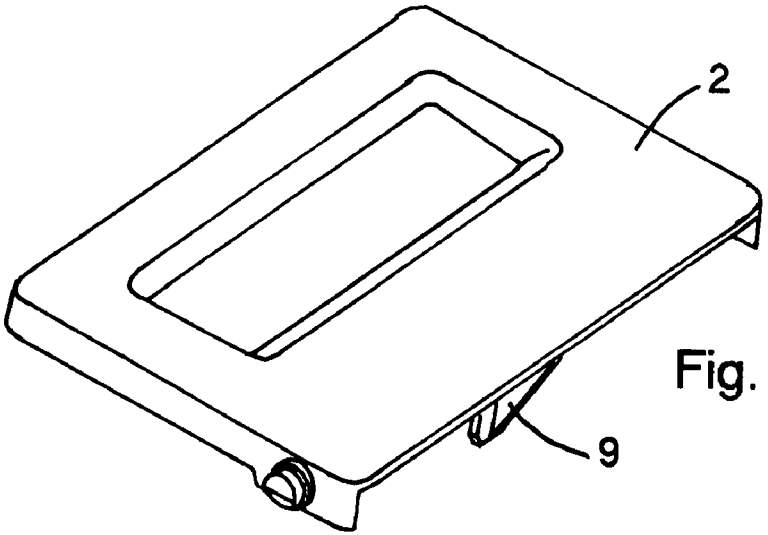
FIG. 36 is a perspective view of the top of the handle of the latch of FIG. 1.
Figure 37:
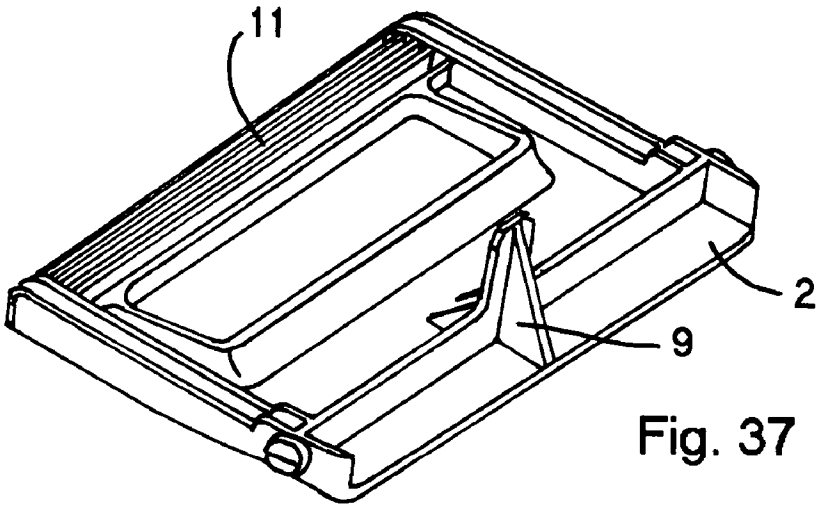
FIG. 37 is a perspective view of the bottom of the handle of the latch of FIG. 1.
Figure 39:
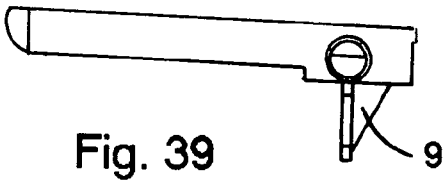
FIG. 39 is a side view of the handle of the latch of FIG. 1.
Figure 41:
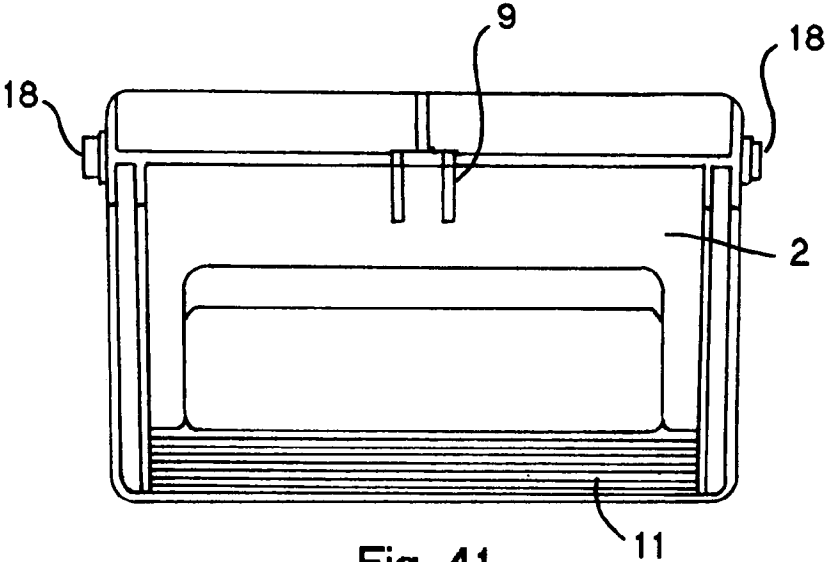
FIG. 41 is a bottom view of the handle of the latch of FIG. 1.
Figure 38:
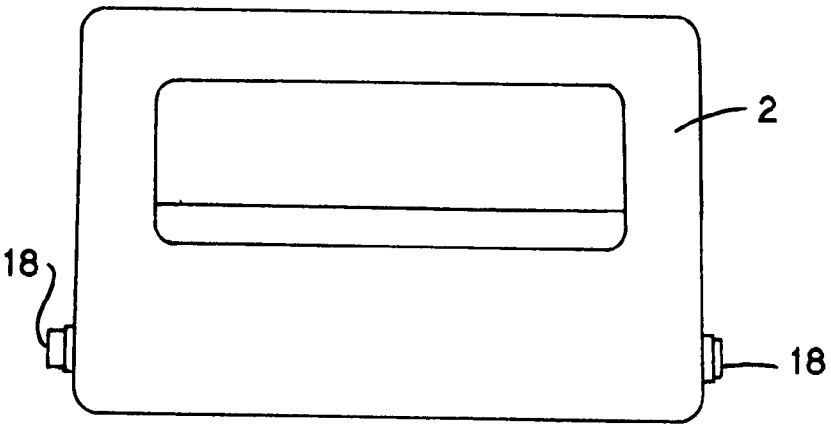
FIG. 38 is a top plan view of the handle of the latch of FIG. 1.
Figure 40:
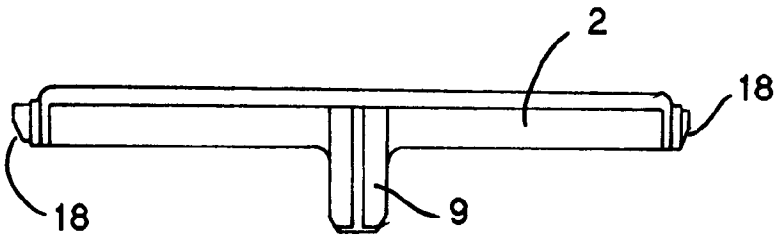
FIG. 40 is a front view of the handle of the latch of FIG. 1.
Figure 44:
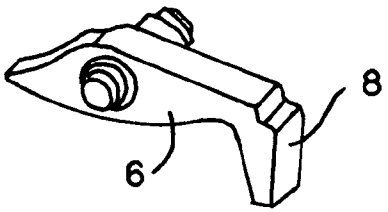
FIG. 44 is a perspective view of the locking arm of the latch of FIG. 1.
Figure 48:
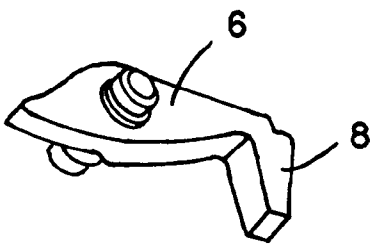
FIG. 48 is a perspective view of the locking arm of the latch of FIG. 1.
Figure 43:
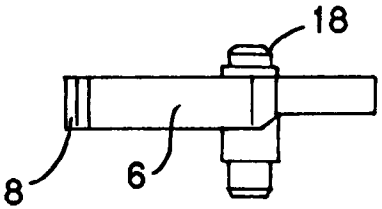
FIG. 43 is a top view of the locking arm of the latch of FIG. 1.
Figure 46:
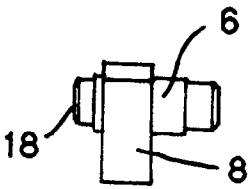
FIG. 46 is a rear view of the locking arm of the latch of FIG. 1.
Figure 47:
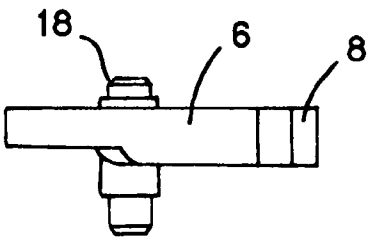
FIG. 47 is a bottom view of the locking arm of the latch of FIG. 1.
Figure 42:
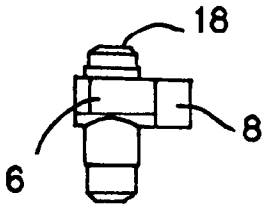
FIG. 42 is a front view of the locking arm of the latch of FIG. 1.
Figure 45:
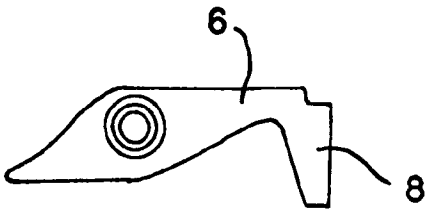
FIG. 45 is a side view of the locking arm of the latch of FIG. 1.
Figure 52:
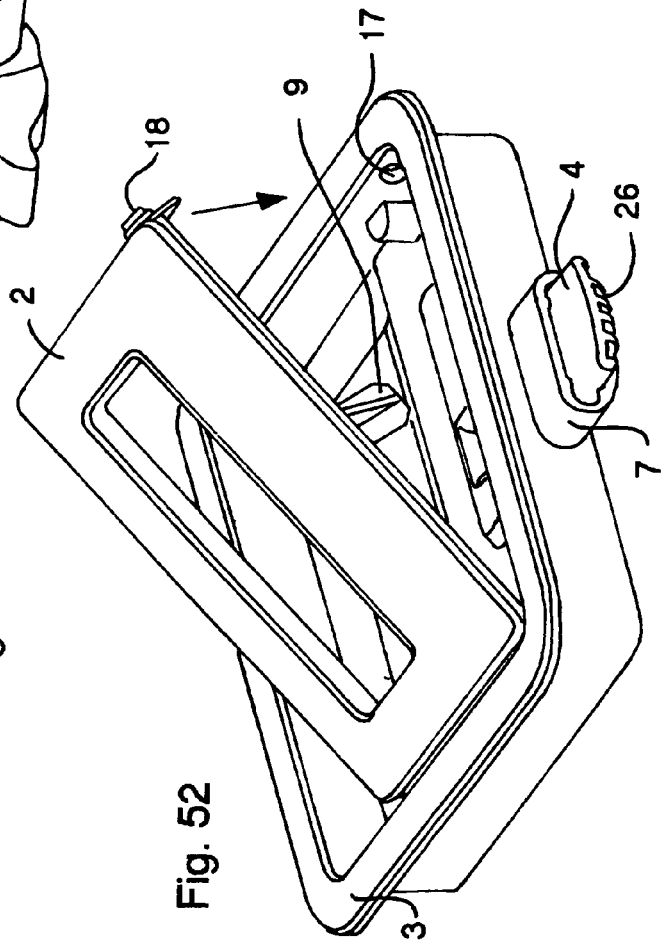
FIG. 52 is a perspective view of the latch of FIG. 1 showing the handle being fitted to the upper housing piece.

FIGS. 36 and 37 show the handle 2 of the latch 1. The handle 2 features a handle actuator 9 which pivots with the handle 2 and contacts an interior face 25 of the main pawl 4 as shown in FIG. 10. The handle can be connected to the housing by aligning the snap fit protuberances 18 of the handle with the snap fit holes 17 of the housing 3 as shown in FIG. 52. The handle can have a ribbed grip portion 11 as seen in FIG. 37.

Figure 53:
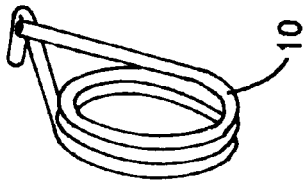
FIG. 53 is a perspective view of the locking arm of the latch of FIG. 1 showing a torsion spring being fitted to the locking arm.
Figure 54:
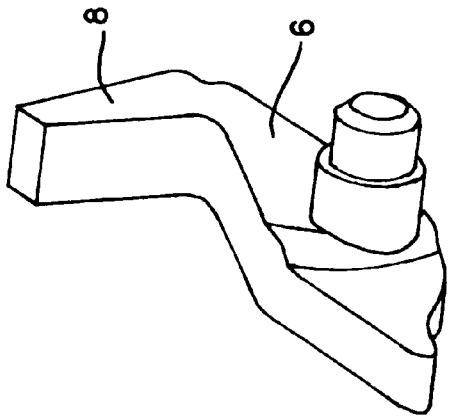
FIG. 54 is a perspective view of the locking arm and torsion spring of the latch of FIG. 1.
Figure 54:
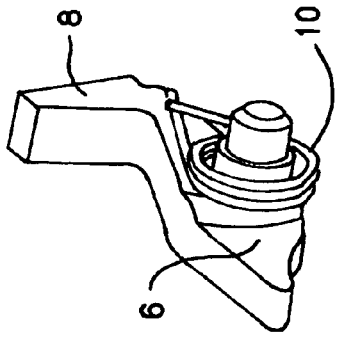
Figure 55:
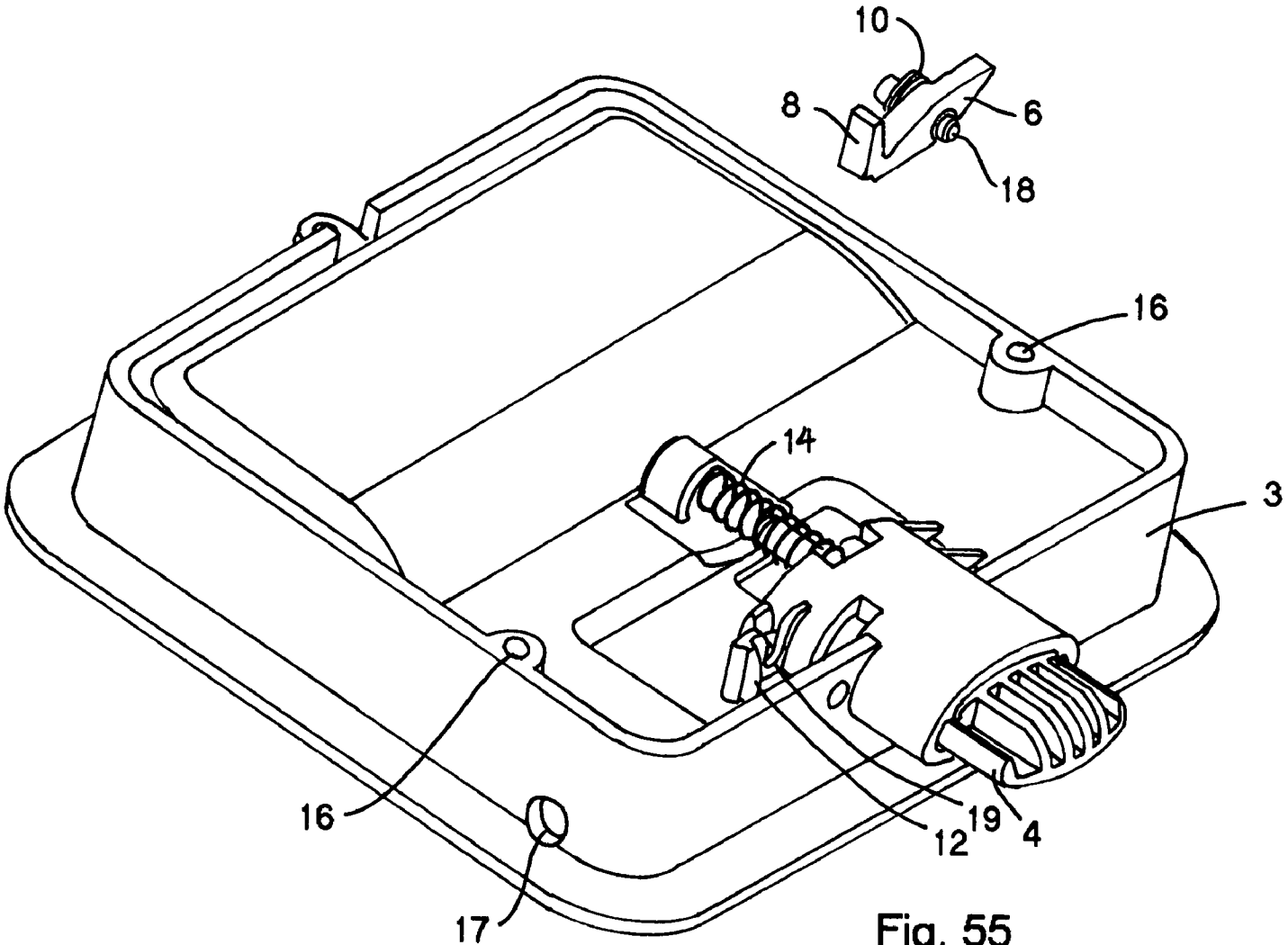
FIG. 55 is a perspective view of the bottom of the upper housing piece of the latch of FIG. 1 showing the locking arm and torsion spring being inserted against the torsion spring shoulder.
Figure 56:
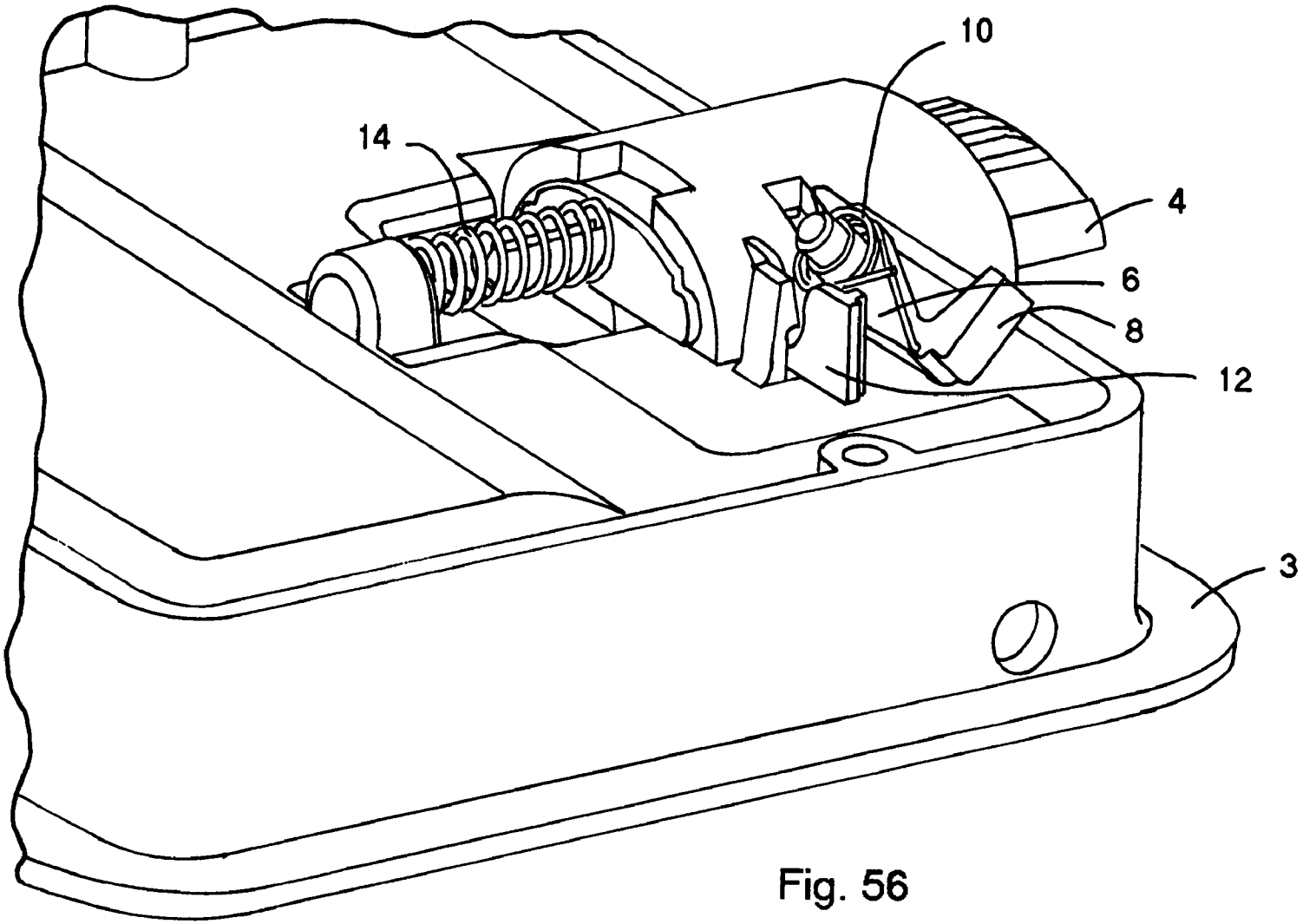
FIG. 56 is a perspective view of the locking arm and torsion spring being inserted into the upper housing piece.
Figure 57:
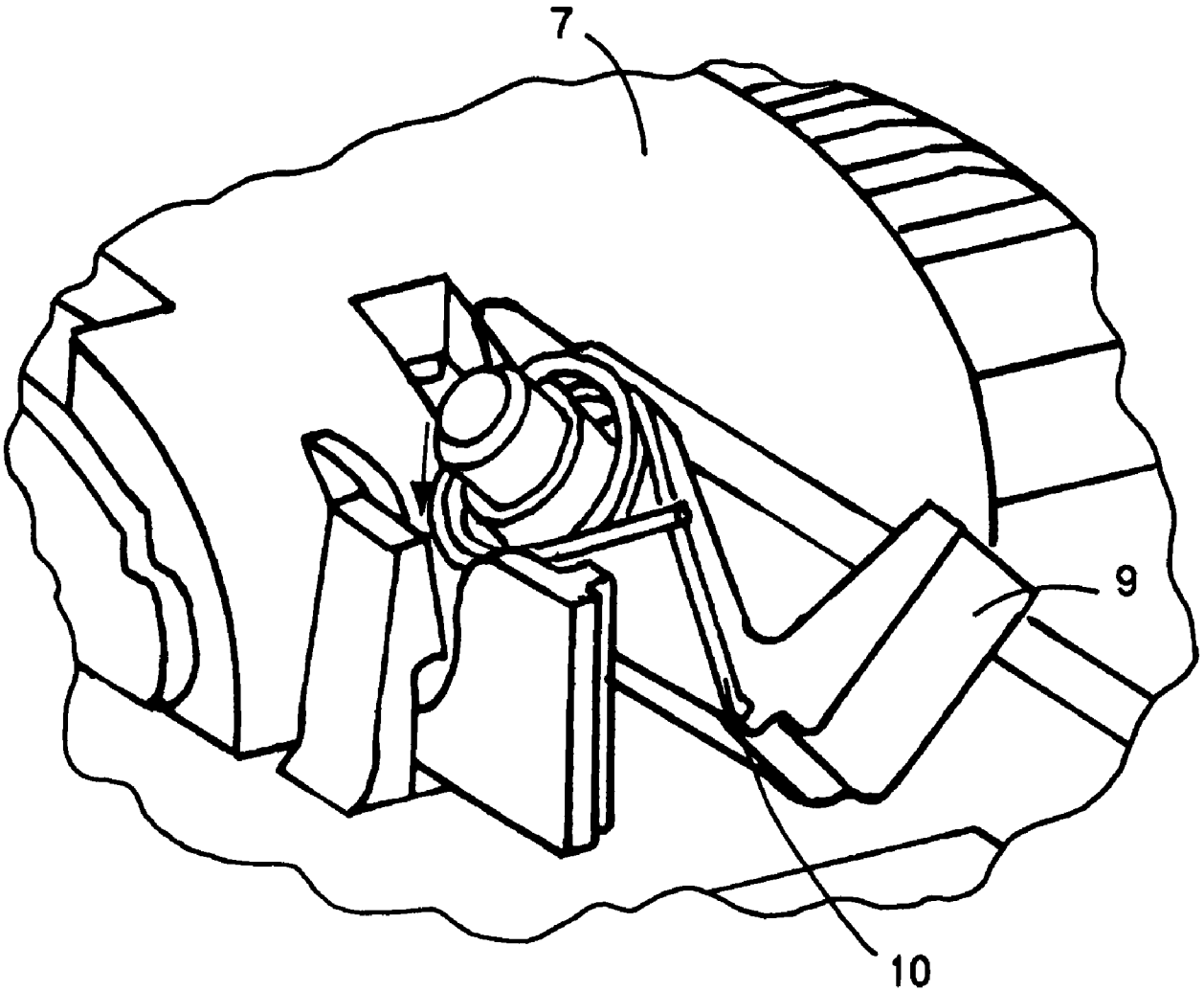
FIG. 57 is a perspective view of the locking arm and torsion spring being inserted into the upper housing piece.
Figures 58, 59:
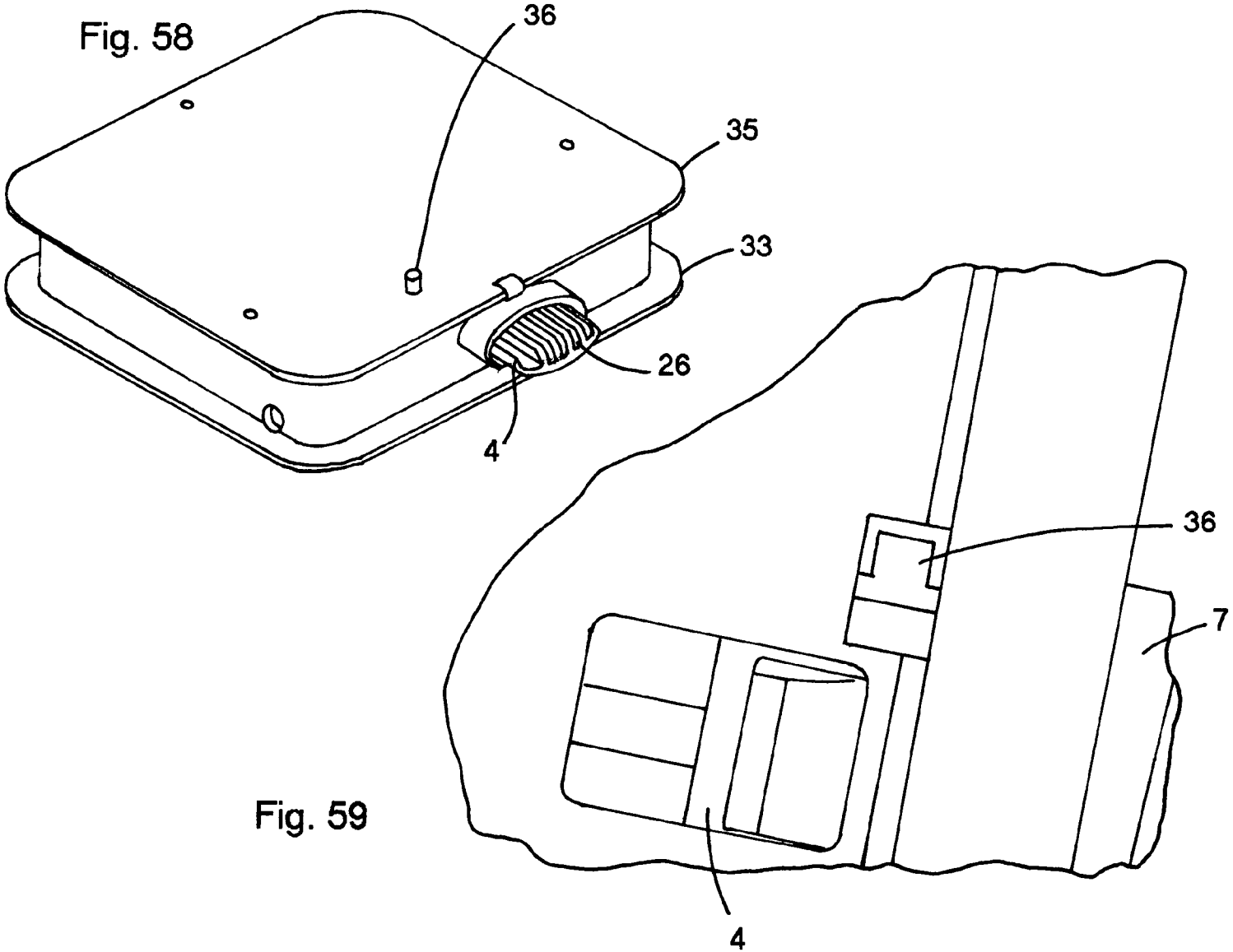
FIG. 58 is a perspective view of a second embodiment of a load floor latch of the present invention showing a detent.
FIG. 59 is a bottom view of a portion of the load floor latch of FIG. 58 showing a detent for contacting a second closure member.
Figure 60:
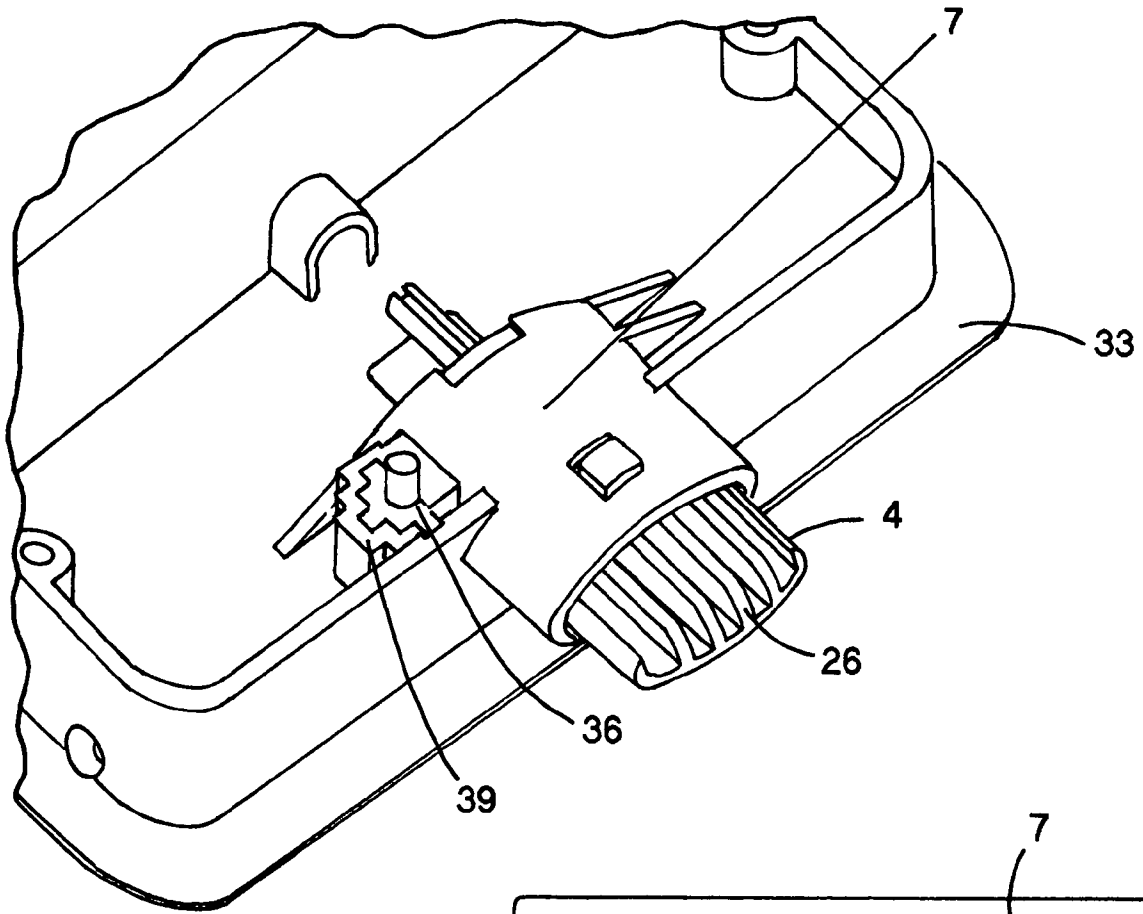
FIG. 60 is a perspective view of the bottom of the upper housing piece of the load floor latch of FIG. 58 showing the detent and detent guide.
Figure 61:
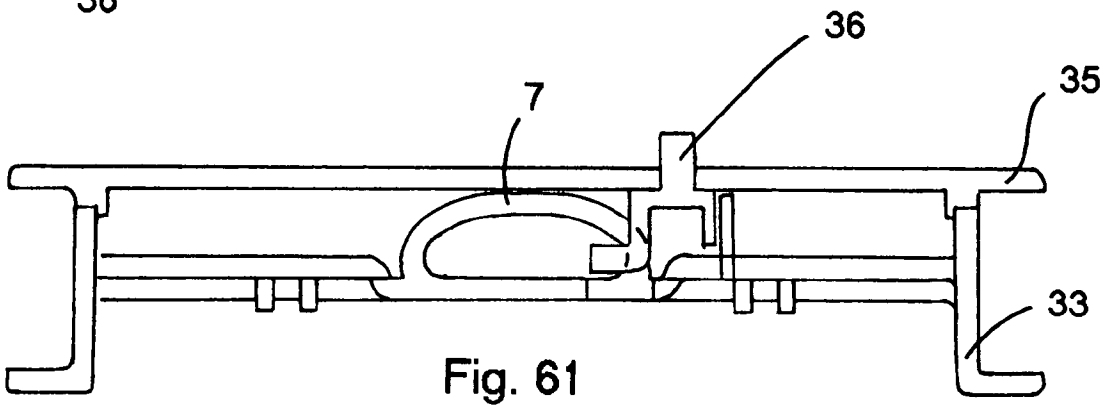
FIG. 61 is a side view of the load floor latch of FIG. 58.
Figure 62:
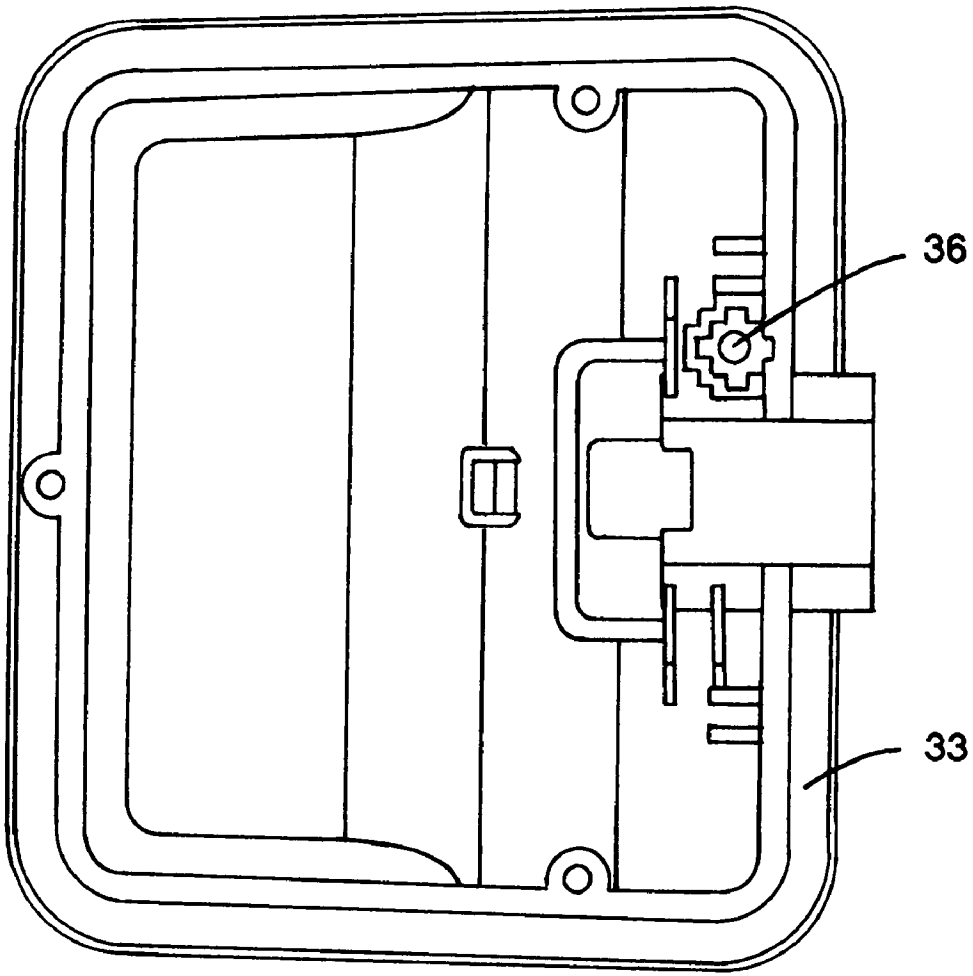
FIG. 62 is a top view of the load floor latch of FIG. 58.
Figure 64:
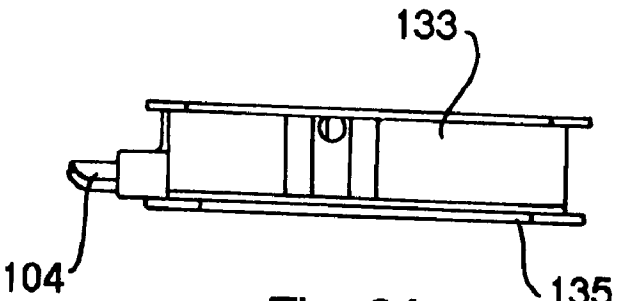
FIG. 64 is a side lavational view of the load floor latch of FIG. 63.
Figure 66:
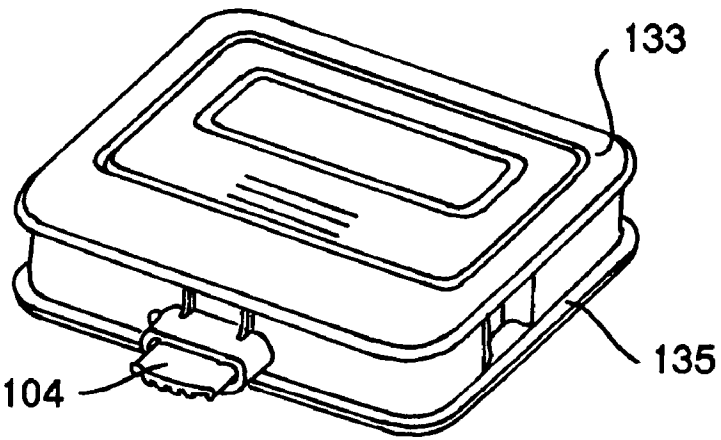
FIG. 66 is a perspective view of the load floor latch of FIG. 63.
Figure 63:
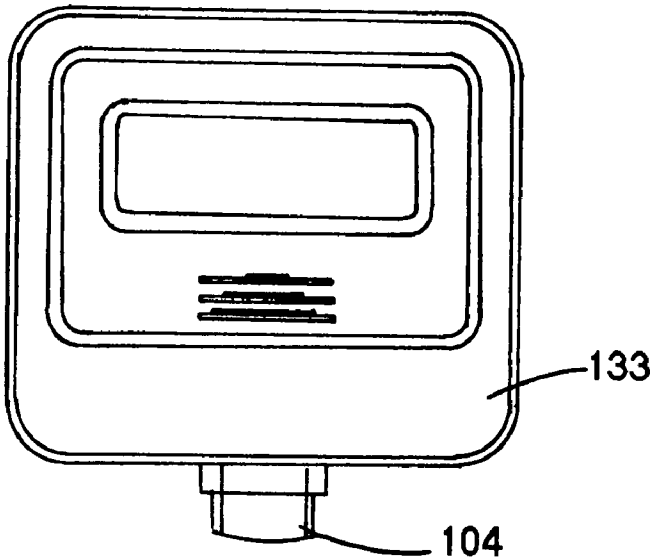
FIG. 63 is a top plan view of a third embodiment of a load floor latch of the present invention.
Figure 65:
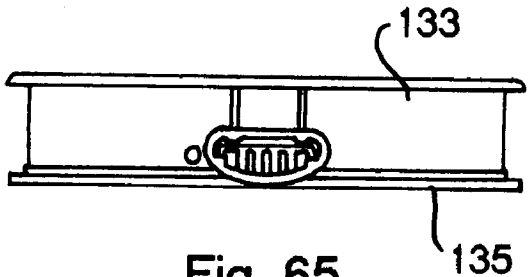
FIG. 65 is a front lavational view of the load floor latch of FIG. 63.
Figure 68:
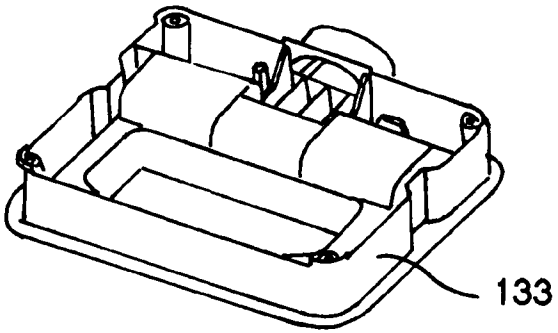
FIG. 68 is a perspective view of the bottom of the upper housing of the load floor latch of FIG. 63.
Figure 70:
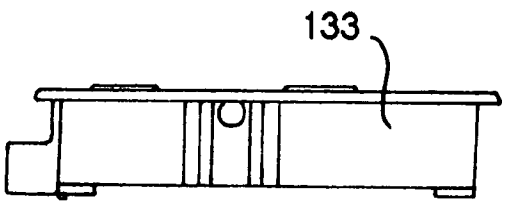
FIG. 70 is a side lavational view of the upper housing of the load floor latch of FIG. 63.
Figure 67:
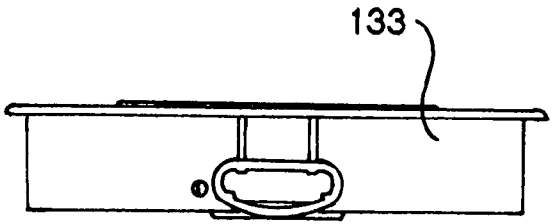
FIG. 67 is a front lavational view of the upper housing of the load floor latch of FIG. 63.
Figure 69:
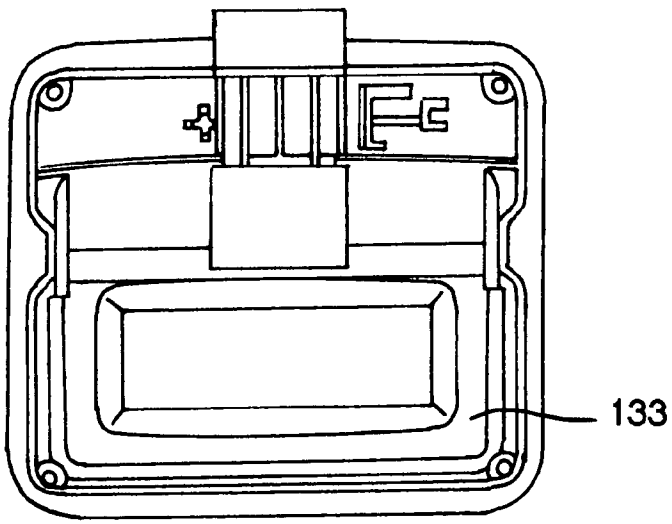
FIG. 69 is a bottom plan view of the bottom of the upper housing of the load floor latch of FIG. 63.
Figure 72:
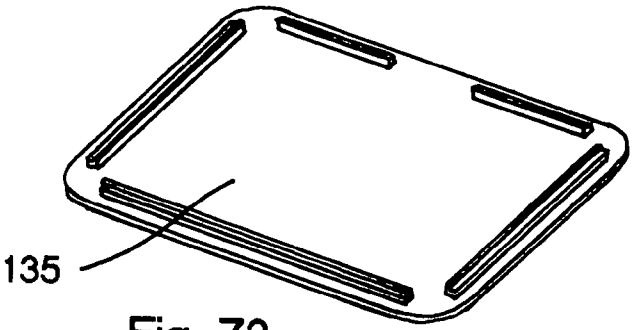
FIG. 72 is a perspective view of the top of the lower housing of the load floor latch of FIG. 63.
Figure 74:
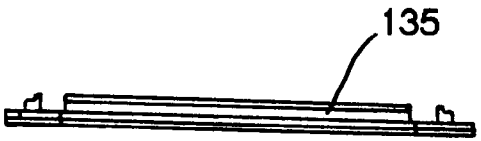
FIG. 74 is a side lavational view of the lower housing of the load floor latch of FIG. 63.
Figure 71:
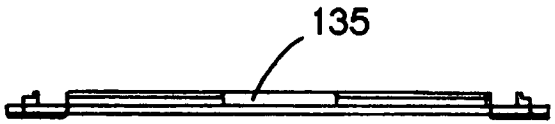
FIG. 71 is a front lavational view of the lower housing of the load floor latch of FIG. 63.
Figure 73:
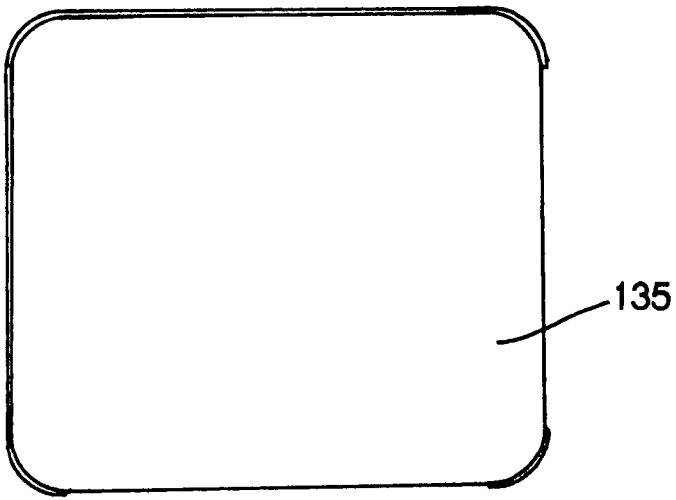
FIG. 73 is a bottom plan view of the bottom of the lower housing of the load floor latch of FIG. 63.
Figure 77:
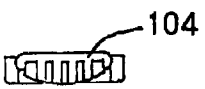
FIG. 77 is a front lavational view of the pawl of the load floor latch of FIG. 63.
Figure 76:
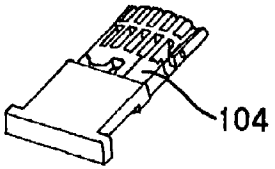
FIG. 76 is a perspective view of the bottom of the pawl of the load floor latch of FIG. 63.
Figure 75:
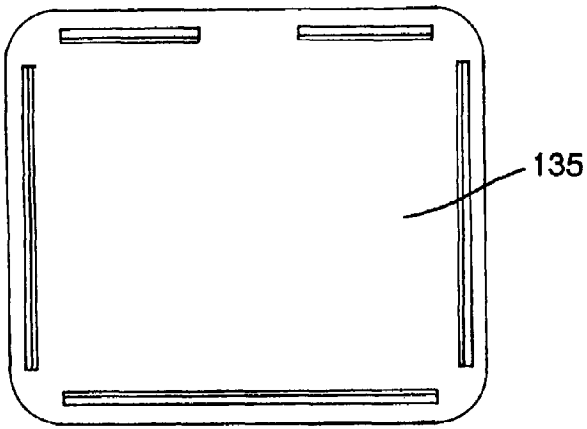
FIG. 75 is a top plan view of the lower housing of the load floor latch of FIG. 63.
Figure 79:
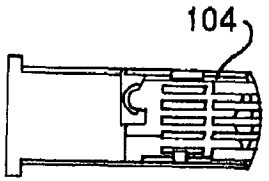
FIG. 79 is a bottom plan view of the pawl of the load floor latch of FIG. 63.
Figure 78:
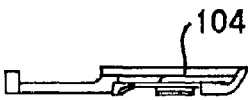
FIG. 78 is a side lavational view of the right side of the pawl of the load floor latch of FIG. 63.
Figure 81:
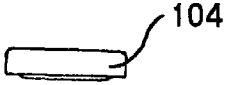
FIG. 81 is a rear lavational view of the pawl of the load floor latch of FIG. 63.
Figure 80:
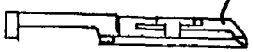
FIG. 80 is a left side lavational view of the pawl of the load floor latch of FIG. 63.
Figure 83:
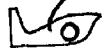
FIG. 83 is a right side lavational view of the locking arm of the load floor latch of FIG. 63.
Figure 82:
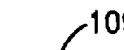
FIG. 82 is a perspective view of the locking arm of the load floor latch of FIG. 63.
Figure 86:
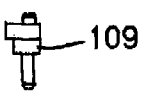
FIG. 86 is a rear side lavational view of the locking arm of the load floor latch of FIG. 63.
Figure 85:
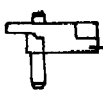
FIG. 85 is a top plan view of the locking arm of the load floor latch of FIG. 63.
Figure 84:
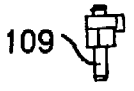
FIG. 84 is a front side lavational view of the locking arm of the load floor latch of FIG. 63.
Figure 87:
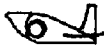
FIG. 87 is a left side lavational view of the locking arm of the load floor latch of FIG. 63.

During assembly of a preferred embodiment of the present invention, torsion spring 10 can be fitted to locking arm 6 in FIGS. 53 and 54. The locking arm 6 and torsion spring 10 can be placed in locking arm support member 19 in FIG. 55 and one end of the torsion spring can be placed on torsion spring shoulder 12 as seen in FIGS. 56 and 57. The snap fit protuberance 18 on the locking arm can be placed in the snap fit hole to attach the locking arm to the housing. The latch can be placed in an aperture in a first closure member which a user desires to fasten to a second closure member.

Figure 11:
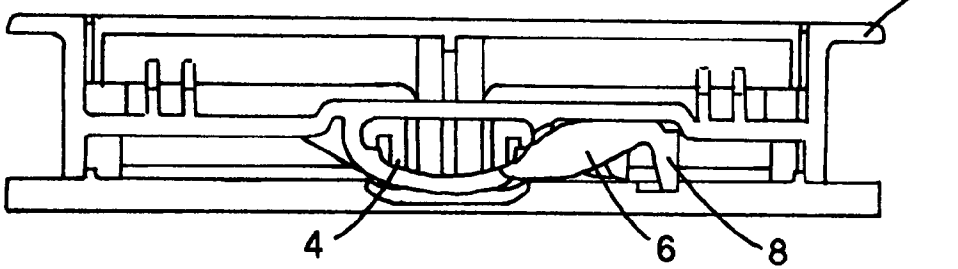
FIG. 11 is a sectional view of the latch of FIG. 1 with the pawl in the fully extended position.
Figure 15:
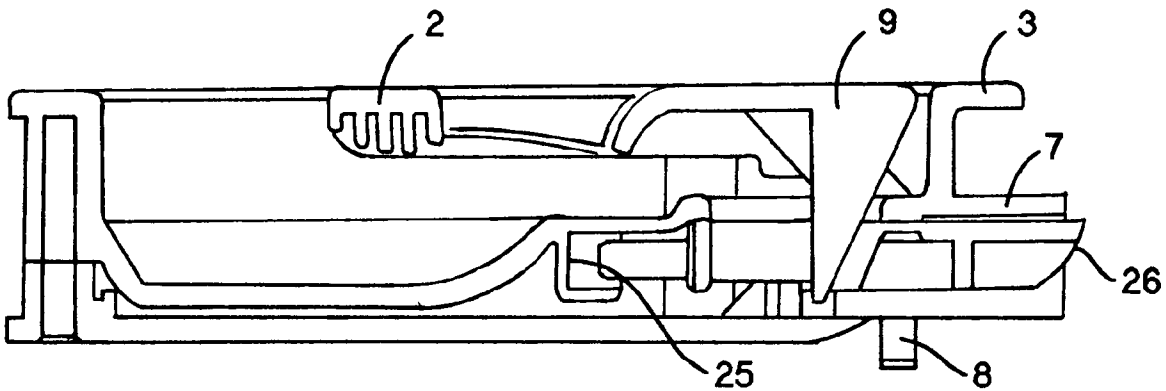
FIG. 15 is a cross sectional side view of the latch of FIG. 1 with the handle at rest and the pawl retracted and engaged by the locking arm.
Figure 16:
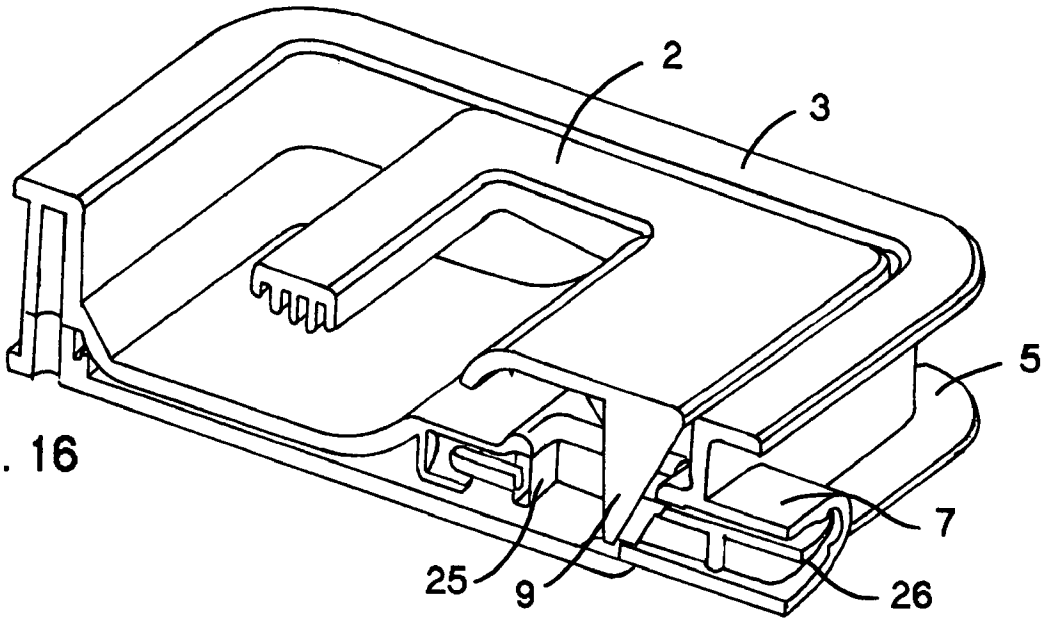
FIG. 16 is a perspective view of the latch of FIG. 1 shown in cross section with the pawl retracted.
Figure 17:
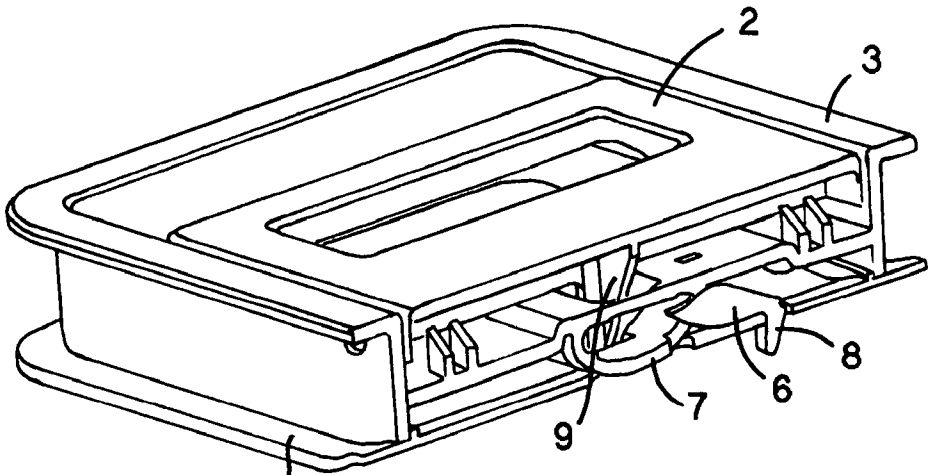
FIG. 17 is a perspective view of the latch of FIG. 1 shown in cross section with the handle in an at rest position and the pawl removed and the locking arm in an engaged position.
Figure 19:
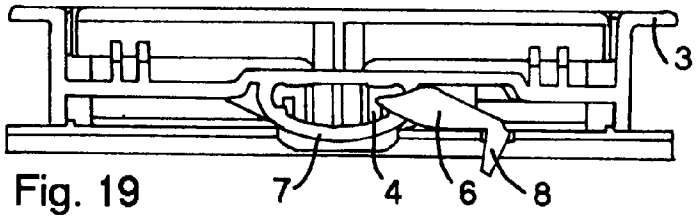
FIG. 19 is a cross sectional side view of the latch of FIG. 1 shown in cross section with the handle in an at rest position and the pawl retracted and the locking arm in an engaged position.
Figure 21:
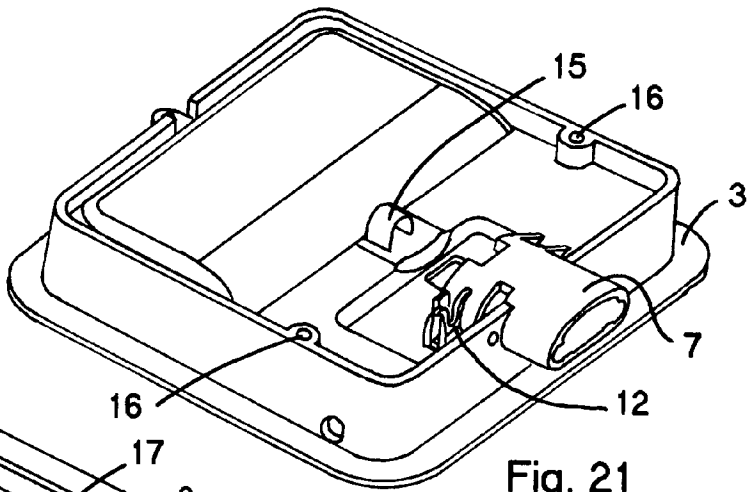
FIG. 21 is a perspective view of the bottom of the upper housing piece for the latch of FIG. 1.
Figure 20:
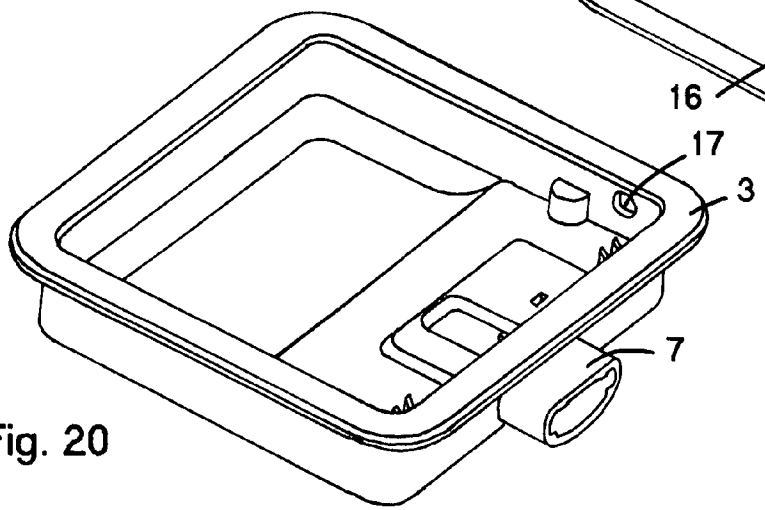
FIG. 20 is a perspective view of the upper housing piece for the latch of FIG. 1.
Figure 18:
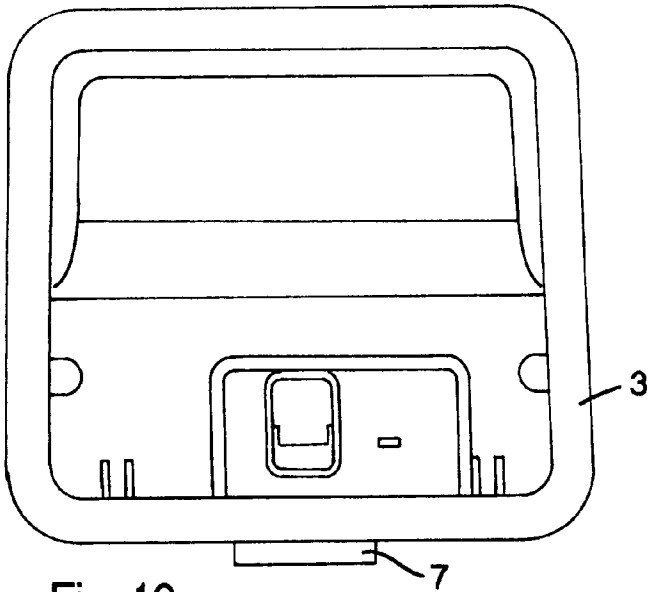
FIG. 18 is a top plan view of the upper housing for the latch of FIG. 1.
Figure 23:
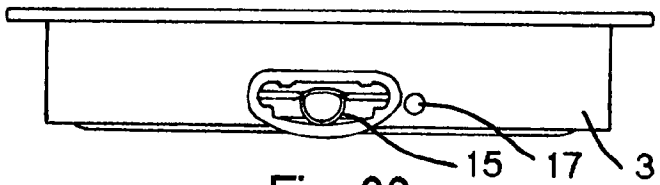
FIG. 23 is a front view of the upper housing piece for the latch of FIG. 1.
Figure 22:
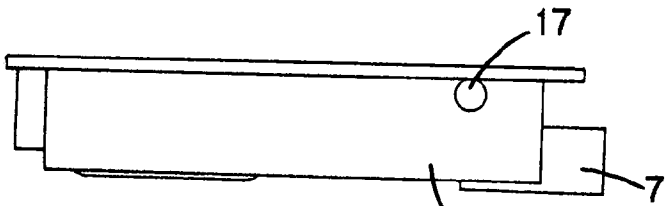
FIG. 22 is a side view of the upper housing piece for the latch of FIG. 1.

FIG. 11 is a sectional side view of the latch of the present invention shown with the locking arm 6 not being engaged in the slot 13 of pawl 4 thereby allowing the linear force of the compression spring 14 to fully extend the pawl 4. In contrast, in FIG. 12 the latch is retracted and the pawl 4 is held in a retracted position due to the engaging of the locking arm 6 in slot 13 of pawl 4. It should be noted in FIG. 11 that the torsion spring 10 is in a compressed state due to the application of a force on the locking arm projection 8 while in FIG. 12 the locking arm is in a rest position due to the torsion spring 10 forces on the locking arm 6 which tend to pivot the locking arm 6 such that the locking arm projection 8 extends out of the plane of the lower housing. The locking arm 6 is maintained in a rest position as shown in FIGS. 12 and 13 while the handle 2 is being actuated and also in FIGS. 15 and 19 when the handle 2 is in the rest position due to the engagement of locking arm projection 8 in slot 13 of pawl 4.

Upon closing of the first closure member to which the latch is affixed, locking arm projection 8 contacts the second closure member which causes a pivoting of locking arm 6 such that the locking arm 6 no longer engages the slot in pawl 4, thus permitting pawl 4 to extend in a direction away from the housing of the latch 1.

The handle actuator 9 of the latch 1 must be actuated thereby retracting the pawl 4 for the latch to open from the latched position. When the handle actuator 9 is actuated the latch 1 can be opened from the closed position and the first closure member can be unlatched from the second closure member.

However, when the latch is in the open position with the pawl 4 retracted the first closure member to which the latch is connected can be slammed against the second closure member which has a keeper in order to close the latch.

Since the latch can be closed while the pawl is held in a retracted position, greater pawl interferences can occur with a second closure member or panel for a particular thickness of a pawl which is attached to a first closure member. Also, reduced wear occurs on the pawl when the latch is in continuous use due to the fact that the pawl is retracted until the first closure member is in the fully closed and latched position. The above-mentioned advantages of the latch of the present invention occur due to the engaging of the locking member with a slot on the pawl when the pawl is in the retracted position. In addition, contact of the locking arm projection against the second closure member which pivots the locking arm permits the latch to be closed by a slamming action of the first closure member against the second closure member.

In the second embodiment of the present invention, a latch is disclosed as shown in FIGS. 58-62, a detent 36 for engaging said pawl 4 in a retracted position, wherein said detent 36 disengages from said pawl 4 upon contact of said detent 36 with the second closure member (not shown) thereby permitting movement of said pawl 4 to the latched position. Detent 36 projects below the lower housing piece 35 and can be biased, preferably in a linear direction, such that a force is applied by a biasing device which tends to place the detent in a fully extended position in which the detent 36 engages the pawl 4. The latch is shown having an upper housing piece 33. When a force is applied on the detent 36 in the direction toward the upper housing piece 33, the detent 36 disengages the pawl 4 and the pawl 4 is thusly permitted to move to an extended and latched position as the pawl 4 is extended.

The detent 36 can move linearly for engaging and disengaging the pawl 4. When contact is made upon a portion of the detent 36 which projects away from the lower housing piece 35 the detent will disengage the pawl 4 and the pawl 4 can move to a latched position. When the force due to the contact is removed the detent will then engage the pawl when the detent engages a corresponding engaging portion of the pawl or a corresponding engaging device on the pawl. This prevents further movement of the pawl 4 of the latch until the detent is once again disengaged with the pawl 4. Detent guide 39 can guide the linear movement of the detent 36 when contact is made with the second closure member.

Figure 90:
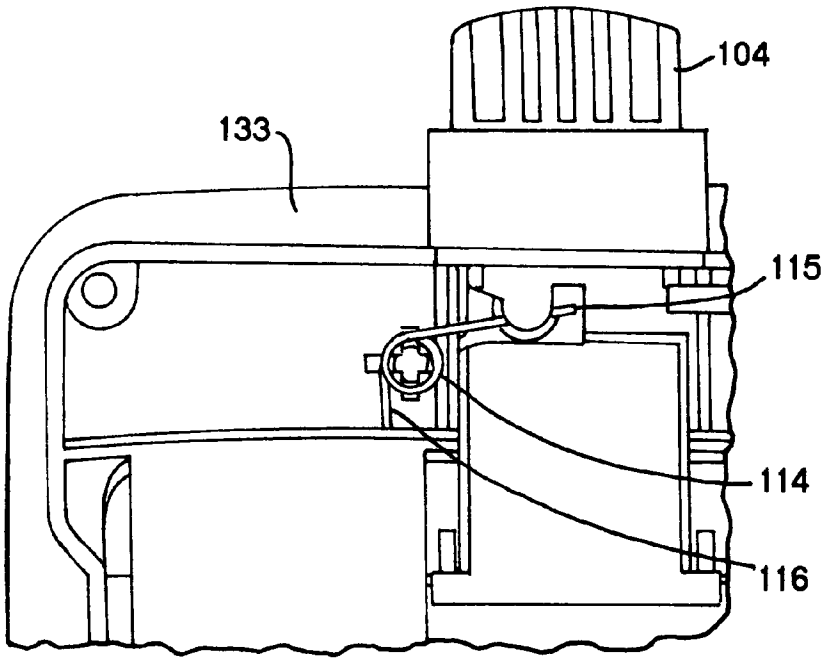
FIG. 90 is a bottom plan view of a portion of the upper housing of the load floor latch of FIG. 63 showing the pawl torsion spring post.
Figure 89:
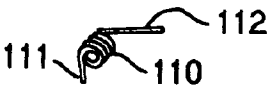
FIG. 89 is a perspective view of the locking arm torsion spring of the load floor latch of FIG. 63.
Figure 88:
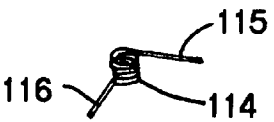
FIG. 88 is a perspective view of the pawl torsion spring of the load floor latch of FIG. 63.
Figure 91:
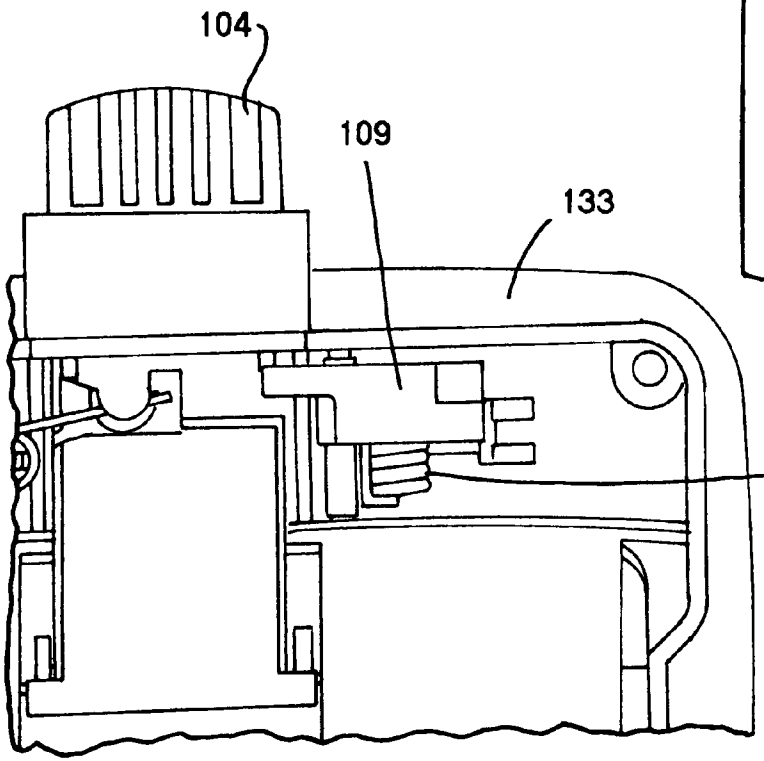
FIG. 91 is a bottom plan view of a portion of the upper housing of the load floor latch of FIG. 63 showing the locking arm torsion spring.
Figure 94:
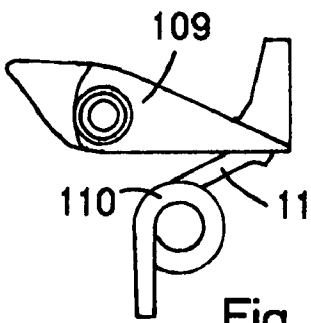
FIG. 94 is a side view of the locking arm and locking arm torsion spring of the load floor latch of FIG. 63.
Figure 95:
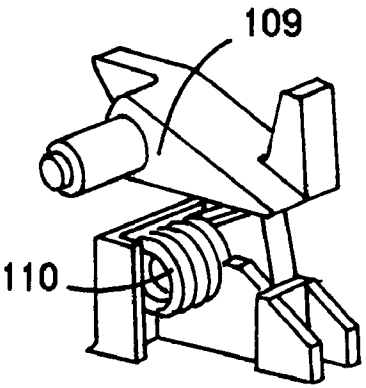
FIG. 95 is a perspective view showing operation of the locking arm and the locking arm torsion spring.
Figure 92:
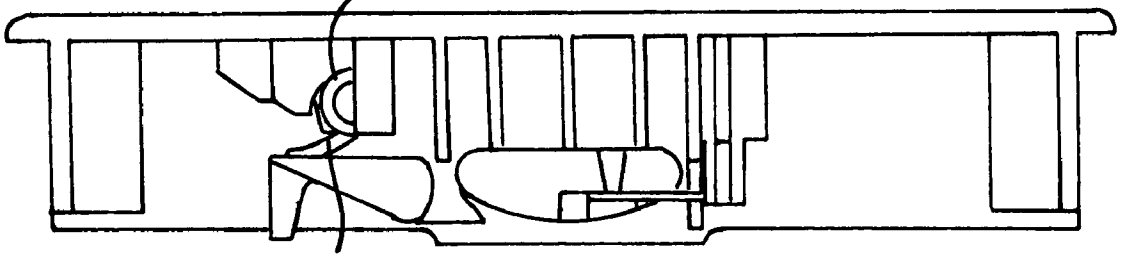
FIG. 92 is a sectional view of the upper housing of the load floor latch of FIG. 63.
Figure 93:
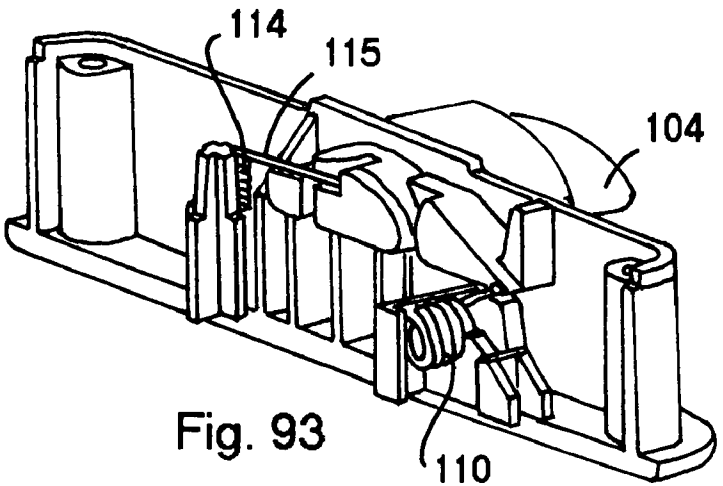
FIG. 93 is a perspective view of a section of the upper housing of the load floor latch of FIG. 63.

In the third embodiment of the present invention, the load floor latch has a pawl torsion spring 114 having a spring leg 115 which extends into a hole in pawl 104 as seen in FIG. 90. The pawl torsion spring 114 biases the pawl 104 toward an extended position. Fixed spring leg 116 can be located and fixed in position in a spring hole as the pawl torsion spring 114 itself can be located on a post 117 as shown in FIG. 90.

The load floor latch also has locking arm 109 which extends into a notch in pawl 104 and is configured and dimensioned to prevent the pawl from extending or moving into a retracted position when the locking arm 109 engages with the pawl 104. Fixed spring leg 111 of locking arm spring 110 can be held fixed in position by a depression or hole on the latch such that active spring leg 112 provides a biasing force on the locking arm 109 to return the locking arm into a locked position.

A configuration of the upper housing 133 and lower housing 135 is shown in FIGS. 67-70 and FIGS. 71-75.

It will be recognized by those skilled in the art that changes may be made by the above-described embodiments of the invention without departing from the broad inventive concepts thereof. For example, each of the features described above do not all need to be included in a single device. Rather, one or more features can be provided in a single device where desired and in any combination. It is understood, therefore, that this invention is not limited to the particular embodiment disclosed, but it is intended to cover all modifications which are within the scope and spirit of the invention.

We claim:

1. A latch for releasably securing a first closure member to a second closure member in a latched position, the latch comprising:

a housing adapted for being received in an aperture formed in the first closure member, said housing having a front surface, a top surface, and a bottom surface, wherein said front surface extends from said bottom surface towards said top surface;

a handle pivotally attached to said housing and being moveable between an open and a closed position, said handle having an actuator;

a pawl slidably supported by said housing so as to be movable from a latched position projecting from said front surface to an unlatched position upon pivoting of said handle to the open position by engagement of said actuator with said pawl;

pawl biasing means for biasing said pawl toward the latched position;

a locking arm pivotally supported by said housing, said locking arm maintaining said pawl in a retracted position in which said pawl is prevented from moving when said locking arm is engaging said pawl, said locking arm having a portion that forms a projection, said locking arm being pivotally movable between a position in which said locking arm is engaging said pawl and a position in which said locking arm is disengaged from said pawl, said projection projecting outward from said bottom surface of said housing when said locking arm is engaging said pawl such that said locking arm is disengaged from said pawl upon contact of said projection with the second closure member to thereby permit sliding movement of said pawl to the latched position; and locking arm biasing means for biasing said locking arm toward the position in which said locking arm is engaging said pawl.

2. The latch according to claim 1 wherein the pawl biasing means is a spring.

3. The latch according to claim 2 wherein the pawl has an interior face which contacts the actuator on the handle during pivoting movement of the handle.

4. The latch according to claim 3 wherein the pawl has a slot for engagement with the locking arm.

5. The latch according to claim 2 wherein the handle is ring-shaped for gripping by a user.

6. The latch according to claim 3 wherein the handle has a ribbed portion for gripping by a user.

7. The latch according to claim 2 wherein the housing has a spring guide for supporting the spring of the pawl biasing means.

8. The latch according to claim 1 wherein said pawl biasing means is a pawl torsion spring and said housing has a post on which said pawl torsion spring is mounted.

9. The latch according to claim 1 wherein said locking arm biasing means is a torsion spring.

10. The latch according to claim 9 wherein the torsion spring of said locking arm biasing means has two legs and one of the legs of the locking arm torsion spring engages said locking arm thereby biasing said locking arm toward a position in which said locking arm engages said pawl.

11. A latch for releasably securing a first closure member to a second closure member in a latched position, the latch comprising:

a housing adapted for being received in an aperture formed in the first closure member, said housing having a front surface, a top surface, and a bottom surface, wherein said front surface extends from said bottom surface towards said top surface;

a handle pivotally attached to said housing and being moveable between an open and a closed position, said handle having an actuator;

a pawl slidably supported by said housing so as to be movable from a latched position projecting from said front surface to an unlatched position upon pivoting of said handle to the open position by engagement of said actuator with said pawl, said pawl having a slot;

pawl biasing means for biasing said pawl toward the latched position;

a locking arm pivotally supported by said housing, said locking arm maintaining said pawl in a retracted position in which said pawl is prevented from moving when said locking arm is engaging said slot of said pawl, said locking arm having a portion that forms a projection, said locking arm being pivotally movable between a position in which said locking arm is engaging said pawl and a position in which said locking arm is disengaged from said pawl, said projection projecting outward from said bottom surface of said housing when said locking arm is engaging said pawl such that said locking arm is disengaged from said pawl upon contact of said projection with the second closure member to thereby permit sliding movement of said pawl to the latched position; and locking arm biasing means for biasing said locking arm toward the position in which said locking arm is engaging said pawl.

12. The latch according to claim 11 wherein the pawl biasing means is a spring.

13. The latch according to claim 12 wherein the pawl has an interior face which contacts the actuator on the handle during pivoting movement of the handle.

14. The latch according to claim 12 wherein the handle is ring-shaped for gripping by a user.

15. The latch according to claim 13 wherein the handle has a ribbed portion for gripping by a user.

16. The latch according to claim 12 wherein the housing has a spring guide for supporting the spring of the pawl biasing means.

17. The latch according to claim 11 wherein said pawl biasing means is a pawl torsion spring and said housing has a post on which said pawl torsion spring is mounted.

18. The latch according to claim 11 wherein said locking arm biasing means is a torsion spring.

19. The latch according to claim 18 wherein the torsion spring of said locking arm biasing means has two legs and one of the legs of the locking arm torsion spring engages said locking arm thereby biasing said locking arm toward a position in which said locking arm engages said pawl.

* * * * *

UNITED STATES PATENT AND TRADEMARK OFFICE

CERTIFICATE OF CORRECTION

PATENT NO. : 7,399,009 B2
APPLICATION NO. : 10/920767
DATED : July 15, 2008
INVENTOR(S) : Matthew Hall et al.

It is certified that error appears in the above-identified patent and that said Letters Patent is hereby corrected as shown below:

Column 2, line 60, the word "lavational" should be -- elevational --;
line 63, the word "lavational" should be -- elevational --.

Column 3, line 3, the word "lavational" should be -- elevational --.

Column 4, line 56, the word "lavational" should be -- elevational --;
line 58, the word "lavational" should be -- elevational --;
line 62, the word "lavational" should be -- elevational --.

Column 5, line 1, the word "lavational" should be -- elevational --;
line 3, the word "lavational" should be -- elevational --;
line 9, the word "lavational" should be -- elevational --;
line 15, the word "lavational" should be -- elevational --;
line 17, the word "lavational" should be -- elevational --;
line 21, the word "lavational" should be -- elevational --;
line 23, the word "lavational" should be -- elevational --;
line 27, the word "lavational" should be -- elevational --;
line 33, the word "lavational" should be -- elevational --;
line 35, the word "lavational" should be -- elevational --.

Signed and Sealed this

Twenty-eighth Day of October, 2008

JON W. DUDAS
*Director of the United States Patent and Trademark Office*